US007406286B2

(12) United States Patent
Yoshioka et al.

(10) Patent No.: US 7,406,286 B2
(45) Date of Patent: Jul. 29, 2008

(54) FIXING DEVICE AND IMAGE FORMING APPARATUS INCLUDING A HEATING ROLLER WITH MULTIPLE HEATERS

(75) Inventors: Kenjiro Yoshioka, Nagano (JP); Kiyoteru Katsuki, Nagano (JP); Tomoe Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 505 days.

(21) Appl. No.: 10/776,636

(22) Filed: Feb. 12, 2004

(65) Prior Publication Data

US 2004/0256372 A1 Dec. 23, 2004

(30) Foreign Application Priority Data

Feb. 14, 2003 (JP) ..... P2003-035907
Feb. 14, 2003 (JP) ..... P2003-035908
Mar. 13, 2003 (JP) ..... P2003-067446
Mar. 18, 2003 (JP) ..... P2003-073185

(51) Int. Cl.
*G03G 15/20* (2006.01)

(52) U.S. Cl. ..... 399/328; 219/216

(58) Field of Classification Search ..... 399/285, 399/67, 69; 219/216
See application file for complete search history.

(56) References Cited

U.S. PATENT DOCUMENTS 3,983,441 A * 9/1976 Northrup ..... 313/579
4,384,235 A * 5/1983 Bollon et al. ..... 313/276
4,585,325 A * 4/1986 Euler ..... 399/69
6,539,185 B2 * 3/2003 Hanyu et al. ..... 399/67
6,810,220 B2 * 10/2004 Hamada et al. ..... 399/69

FOREIGN PATENT DOCUMENTS

JP 59038773 A * 3/1984
JP 02034886 A * 2/1990
JP 07064426 A * 3/1995
JP 08-123230 A 5/1996
JP 2001109322 A * 4/2001

* cited by examiner

*Primary Examiner*—Quana M Grainger
(74) *Attorney, Agent, or Firm*—Sughrue Mion, PLLC

(57) ABSTRACT

In a fixing device for causing a pressurizing roller to come in pressure contact with a heating roller including a central region heating heater for heating a central region and a side end region heating heater for heating a side end region on an outside of the central region, thereby fixing an unfixed toner, or an image forming apparatus comprising the fixing device, an outside of an image region of the heating roller is caused to have a peak of heat distribution of the central region heating heater and heat radiated from both side ends of the heating roller is compensated to flatten the temperature distribution of the image region, thereby preventing a deterioration in an image.

25 Claims, 25 Drawing Sheets

$1 = \tau_{1on}/(\tau_{1on} + \tau_{1off})$ $0.3 = \tau_{2on}/(\tau_{2on} + \tau_{2off})$

FIXING DEVICE AND IMAGE FORMING APPARATUS INCLUDING A HEATING ROLLER WITH MULTIPLE HEATERS

The present application is based on Japanese Patent Applications Nos. 2003-35907, 2003-35908, 2003-67446 and 2003-73185, the entire contents of which are incorporated herein by reference.

BACKGROUND OF THE INVENTION

1. Field of the Invention

The present invention relates to a fixing device for causing a pressurizing roller to come in pressure contact with a heating roller including a central region heating heater (first heater) for heating a central region and a side end region heating heater (second heater) for heating a side end region on the outside of the central region, thereby fixing an unfixed developer, and an image forming apparatus comprising the fixing device.

2. Related Art

As a fixing device of an image forming apparatus, in a fixing device including two heaters using two halogen lamps for a heating roller (see Japanese Patent Publication No. JP-A-8-123230, for example), a first heater having a greater calorific value in the central part of the heating roller than that on both side ends and a second heater having a greater calorific value on both side ends of the heating roller than that in the central part are combined to cause a temperature distribution to be uniform corresponding to a passing paper size.

In the fixing device having the two heaters, accordingly, a region in which the halogen lamp is to emit a light and a region in which non-light emission is to be carried out are present in each of the heaters. More specifically, the first heater has a central region in which the light emission is to be carried out and a side end region in which the non-light emission is to be carried out, and the second heater has a central region in which the non-light emission is to be carried out and a side end region in which the light emission is to be carried out. Corresponding to the regions, a coil-shaped filament (hereinafter referred to as a coil filament) is provided in the region in which the light emission is to be carried out, and a wire (hereinafter referred to as a wire filament) is provided in the region in which the non-light emission is to be carried out. Furthermore, the coil filament and the wire filament are to be alternately provided in the region in which the light emission is to be carried out, and a coil-shaped holding portion filament is to be provided in order to eliminate the slack of the wire in the region in which the non-light emission is to be carried out.

However, the holding portion filament emits a light so that a light distribution cannot be set to be zero %. In the conventional device (JP-A-8-123230), therefore, light emission and heat generation which are to be carried out by the holding portion filament present in the central region of the second heater are decreased to 5 to 20% as a whole non-light emitting region so as not to reduce the efficiency of the heater.

However, the holding portion filament is to be provided in the side end regions of the first heater in addition to the central region of the second heater. Also in the side end regions of the first heater, the light distribution of the holding portion filament is present. For this reason, in the case in which the lighting duty of the first heater is high (in case of warm-up and a thick and continuous paper), the temperature of the heating roller in a portion corresponding to a light distribution peak is raised. As a result, if the light distribution peak is present in an image region, there is a problem in that a gloss unevenness is generated on an image or a high temperature offset is generated.

Further, a temperature ripple is generated corresponding to the alternate arrangement of the coil filament and the wire filament in the first heater in the central region as described above, and furthermore, is generated corresponding to the alternate arrangement of the holding portion filament and the wire filament in the second heater. In the case in which the heating roller is heated by using the first heater and the second heater, therefore, these are superposed on each other so that a great temperature ripple is generated. Consequently, there is a problem in that a gloss unevenness is generated on an image in the region in which the non-light emission is to be carried out.

In addition, the temperature ripple generated by the second heater fluctuates due to the ON/OFF operation of the second heater. Consequently, precision in the detection of a temperature sensor for controlling the first heater is deteriorated and a variation in the control of a fixing temperature is increased. Thus, there is a problem in that a gloss unevenness is generated.

SUMMARY OF THE INVENTION

In order to solve the problems, it is an object of the invention to prevent the generation of the gloss unevenness of an image due to the peak of a heat distribution, the generation of a high temperature offset and the temperature ripple on the heating roller so that a deterioration in the image is prevented.

It is another object of the invention to prevent an increase in a variation in the control of a fixing temperature due to the ON/OFF operation of a second heater and the generation of a gloss unevenness, thereby preventing a deterioration in picture quality.

(1) The invention provides a fixing device for causing a pressurizing roller to come in pressure contact with a heating roller including a first heater for heating a central region and a second heater for heating a side end region on an outside of the central region, thereby fixing an unfixed developer, or an image forming apparatus comprising the fixing device, wherein an outside of an image region of the heating roller is caused to have a peak of heat distribution of the first heater, and the first heater has a coil filament and a wire filament provided alternately in the central region and has a holding portion filament provided on the outside of the image region, and is caused to have the peak of heat distribution by the holding portion filament.

(2) The invention provides a fixing device for causing a pressurizing roller to come in pressure contact with a heating roller including a first heater for heating a central region and a second heater for heating a side end region on an outside of the central region, thereby fixing an unfixed developer, and an image forming apparatus comprising the fixing device, wherein both side ends of the heating roller are caused to have a peak of heat distribution of the first heater and a peak of heat distribution of the second heater in an overlap.

The first heater has a coil filament and a wire filament provided alternately in the central region and has a holding portion filament provided on both side ends at the outside of the central region, and is caused to have the peak of heat distribution by the holding portion filament, the second heater has a holding portion filament and a wire filament provided alternately in the central region and has a coil filament and the wire filament provided alternately in the side end region, and is caused to have the peak of heat distribution by the coil filament, and an outside length is set to be greater than an inside length in the coil filament provided in the side end region.

Moreover, a temperature sensor is provided on both side ends of the heating roller having the peak of heat distribution in an overlap, and a temperature sensor is provided in a central part of the heating roller.

(3) The invention provides a fixing device for causing a pressurizing roller to come in pressure contact with a heating roller including a first heater for heating a central region and a second heater for heating a side end region on an outside of the central region, thereby fixing an unfixed developer, and an image forming apparatus mounting the fixing device thereon, wherein a temperature sensor for detecting a temperature of the heating roller is provided in a non-overlapping portion of a heating portion of the first heater and a holding portion of the second heater.

The temperature sensor is provided in the non-overlapping portion of the heating portion of the first heater with the holding portion of the second heater and is provided in a central part of the heating roller.

Moreover, a temperature sensor for detecting a temperature of the heating roller is provided in an overlapping portion of a holding portion of the first heater and a heating portion of the second heater, and the temperature sensor is provided in the overlapping portion of the heating portion of the second heater with the holding portion of the first heater, and is provided on an end of the heating roller.

The first heater includes the central region in which a heating portion formed by a coil filament and a wire filament are arranged alternately, and the side end region in which a holding portion formed by a holding portion filament and a wire filament are arranged alternately, the second heater includes the central region in which a holding portion formed by a holding portion filament and a wire filament are arranged alternately, and the side end region in which a heating portion formed by a coil filament and a wire filament are arranged alternately, an outside length is set to be greater than an inside length in the coil filament provided in the side end region, phases of the alternate arrangement of the holding portion filament and the wire filament and that of the coil filament and the wire filament are shifted from each other, and both side ends of the heating roller are caused to have a peak of heat distribution of the first heater and a peak of heat distribution of the second heater in an overlap.

(4) The invention provides a fixing device for causing a pressurizing roller to come in pressure contact with a heating roller including a first heater for heating a central region and a second heater for heating a side end region on an outside of the central region, thereby fixing an unfixed developer or an image forming apparatus comprising the fixing device, wherein a holding filament and a wire filament in the second heater are provided with phases alternated with those of a coil filament and a wire filament in the first heater which are provided alternately in the central region, and furthermore, a holding filament provided in the central region of the second heater is provided in a position corresponding to a wire filament in a coil filament and the wire filament which are provided alternately in the central region of the first heater.

The both side ends of the heating roller are caused to have a peak of heat distribution of the first heater and a peak of heat distribution of the second heater in an overlap, the first heater has a holding portion filament provided on the both side ends at the outside of the central region, and is caused to have the peak of heat distribution by the holding portion filament, the second heater has a coil filament and a wire filament provided alternately in the side end region, and is caused to have the peak of heat distribution by the coil filament, and an outside length is set to be greater than an inside length in the coil filament provided in the side end region.

DETAILED DESCRIPTION OF THE PREFERRED EMBODIMENTS

Figure 1:
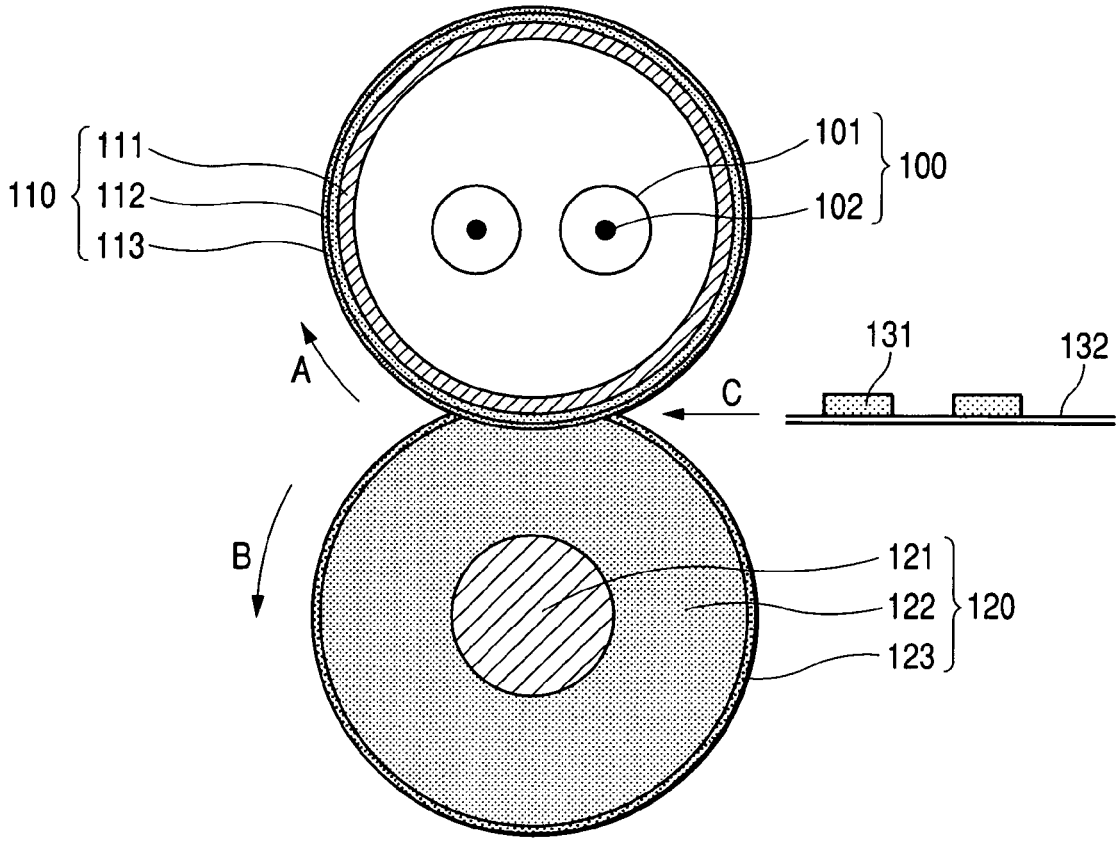
FIG. 1 is a view showing an embodiment of a fixing device according to the invention.

Embodiments of the invention will be described below with reference to the drawings. FIG. 1 is a view showing an embodiment of a fixing device according to the invention and FIG. 2 is a view showing another embodiment of the fixing device according to the invention.

In the embodiment shown in FIG. 1, a halogen lamp 100 is formed by putting a tungsten filament 102 in a quartz glass tube 101, and a heating roller 110 has a pipe member accommodating two heaters including a central region heating heater (a first heater) using the halogen lamp 100 and a side end region heating heater (a second heater) which is provided as a core 111, and an elastic layer 112 on the outer periphery of the core 111, and furthermore, a fluororesin layer 113 on an outer periphery thereof which are provided as parting layers. A pressurizing roller 120 has, as parting layers, an elastic layer 122 provided on the outer periphery of a metal shaft 121 and a fluororesin layer 123 provided on an outer periphery thereof, and is pressurized to come in pressure contact with the heating roller 110.

In the fixing device having the structure, the heating roller 110 and the pressurizing roller 120 are heated and maintained at a high temperature by the halogen lamp 100 and are rotated in directions of arrows A and B in the drawing, and a recording paper 132 having an image formed by an unfixed toner 131 is caused to enter between the heating roller 110 and the pressurizing roller 120 in a direction of an arrow C so that a pressure and heat are applied to the unfixed toner 131. Thus, a fixed image is obtained on the recording paper 132.

Figure 2:
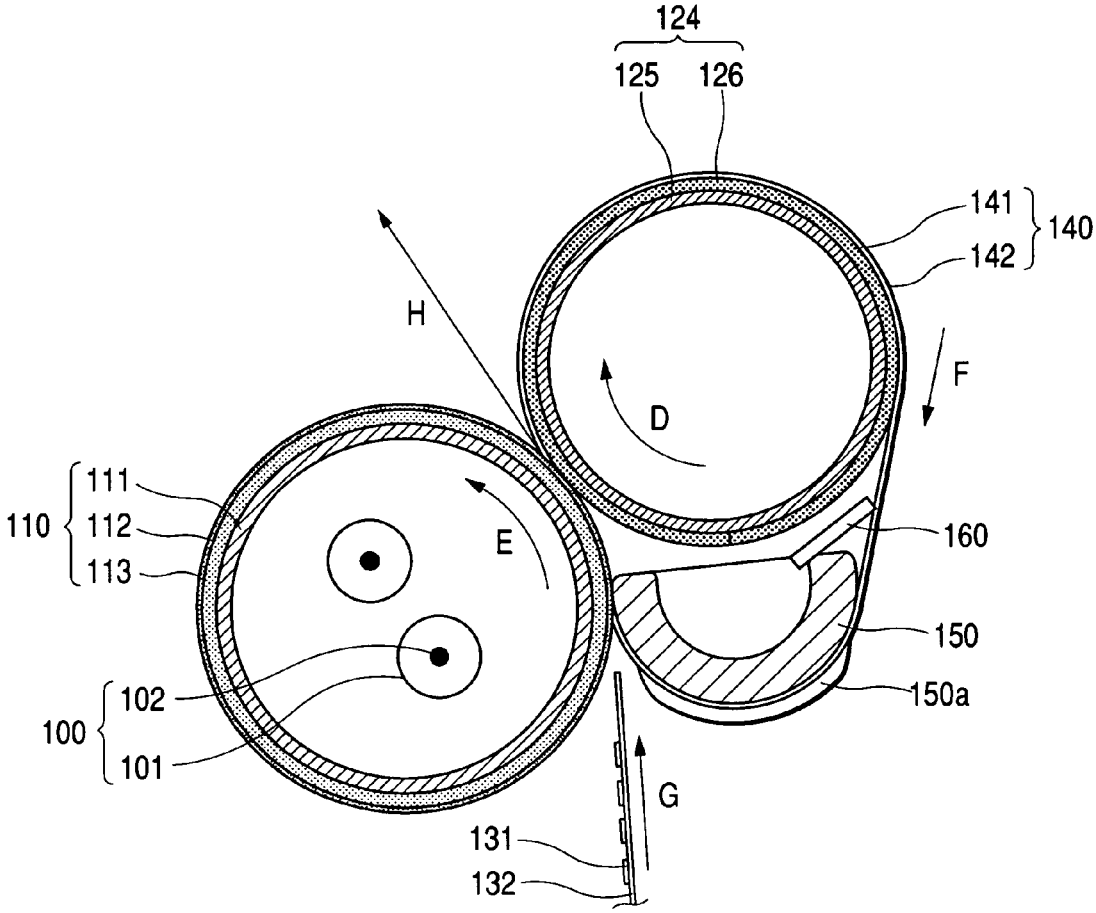
FIG. 2 is a view showing another embodiment of the fixing device according to the invention.

Moreover, FIG. 2 shows another embodiment comprising a belt. A heating roller 110 has such a structure that a pipe member is provided as a core 111, an elastic layer 112 and a fluororesin layer 113 are formed to cover the outer periphery of the core 111 and two halogen lamps 100 are provided as heating sources in the core 111, and is rotatable. A pressurizing roller 124 has such a structure that a core 125 is formed by a pipe member and an elastic layer 126 is provided on an outer periphery thereof, and is provided opposite to the heating roller 110 and comes in pressure contact with the heating roller 110 at a predetermined pressure, and is thus rotatable.

A belt 140 is an endless heat-resistant belt which is interposed between the heating roller 110 and the pressurizing roller 124 and is wound upon the outer periphery of the pressurizing roller 124 to be movable, and has such a structure that a fluororesin layer 142 is provided on a heat-resistant resin layer 141. Moreover, it is also possible to employ a structure using a metal pipe such as a stainless pipe or a nickel electroforming pipe, or a heat-resistant resin pipe such as polyimide or silicone.

A rigid support member 150 is a semicircular belt sliding member inserted in the inner periphery of the belt 140, serving to apply a tension to the belt 140 in cooperation with the pressurizing roller 124 and provided in a position in which the belt 140 is wound upon the heating roller 110 to form a nip. The rigid support member 150 is provided in a position in which the belt 140 is wound upon the heating roller 110 at a pressing portion tangent H of the heating roller 110 and the pressurizing roller 124 to form the nip. The rigid support member 150 is lightly pressed against the heating roller 110 in the initial position of the nip. A convex portion 150*a* is provided on one of ends or the both side ends of the rigid support member 150 and abuts to regulate an approach when the belt 140 approaches one of sides.

In order to provide the belt 140 across the pressurizing roller 124 and the rigid support member 150 to stably drive the belt 140 by the pressurizing roller 124, it is preferable to set a coefficient of friction of the pressurizing roller 124 and the belt 140 to be greater than that of the rigid support member 150 and the belt 140. In some cases, however, the coefficient of friction is unstable due to the invasion of foreign matters or abrasion. On the other hand, if a winding angle of the rigid support member 150 and the belt 140 is set to be smaller than that of the pressurizing roller 124 and the belt 140 and a diameter of the rigid support member 150 is set to be smaller than that of the pressurizing roller 124, the sliding length of the belt 140 along the rigid support member 150 is reduced so that the factor of instability for aging or disturbance can be avoided and the belt 140 can be stably driven by means of the pressurizing roller 124.

A cleaning blade 160 is provided between the pressurizing roller 124 and the rigid support member 150 and serves to come in sliding contact with the inner peripheral surface of the belt 140 to remove foreign matters and abrasion powder on the inner peripheral surface of the belt 140. By removing the foreign matters and the abrasion powder, the belt 140 is refreshed and the factor of instability is eliminated. Moreover, a concave portion provided on the rigid support member 150 is suitable for accommodating the foreign matters and the abrasion powder which are removed.

In a state in which the heating roller 110 is rotated in a direction of an arrow E, the pressurizing roller 124 is rotated in a direction of an arrow D and the belt 140 is rotated in a direction of an arrow F, a recording paper 132 passes between the belt 140 and the heating roller 110 in a tangent direction G by setting, as a nip initial position, a position in which the rigid support member 150 is lightly pressed against the heating roller 110. Consequently, an unfixed toner image 131 is fixed, and the recording paper 132 is discharged in the direction of the pressing portion tangent H by setting, as a nip end position, a position in which the pressurizing roller 124 is pressed against the heating roller 110. Thus, the start and end positions of the nip are formed in the tangent state of the heating roller 110.

Figure 3A:
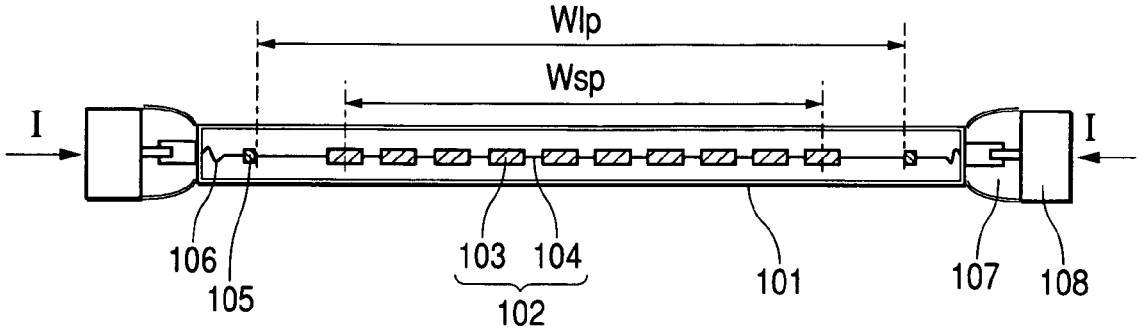
FIG. 3A is a schematic view showing the structure of a first heater in the fixing device according to the embodiment and FIG. 3B is a typical chart showing a heat distribution thereof.
Figure 3B:
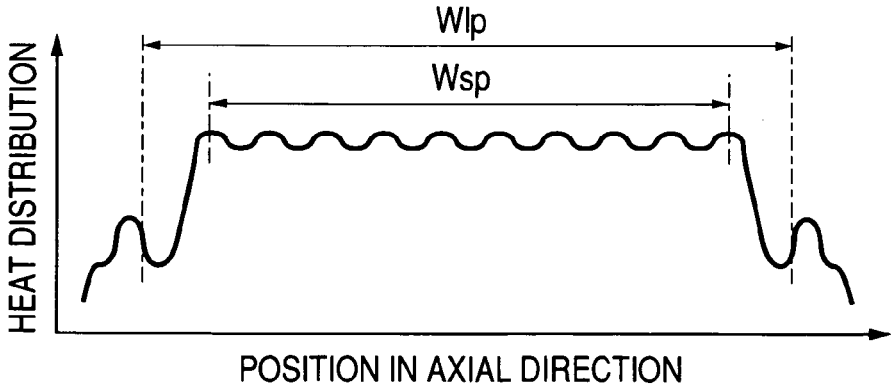
Figure 4A:
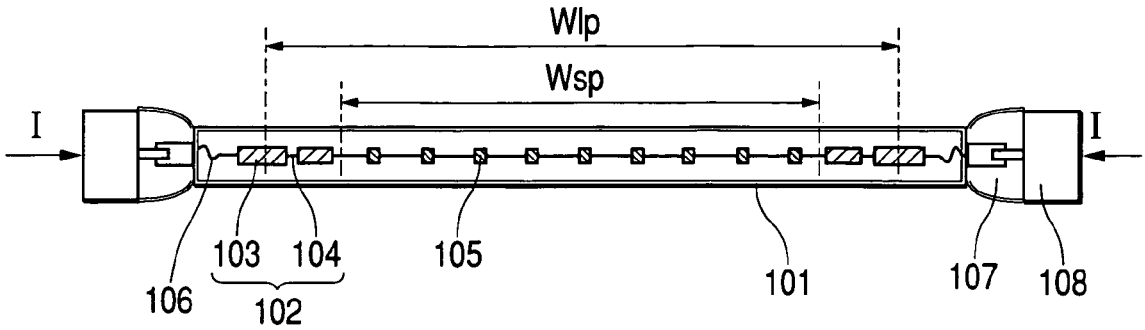
FIG. 4A is a schematic view showing the structure of a second heater in the fixing device according to the embodiment and FIG. 4B is a typical chart showing a heat distribution thereof.
Figure 4B:
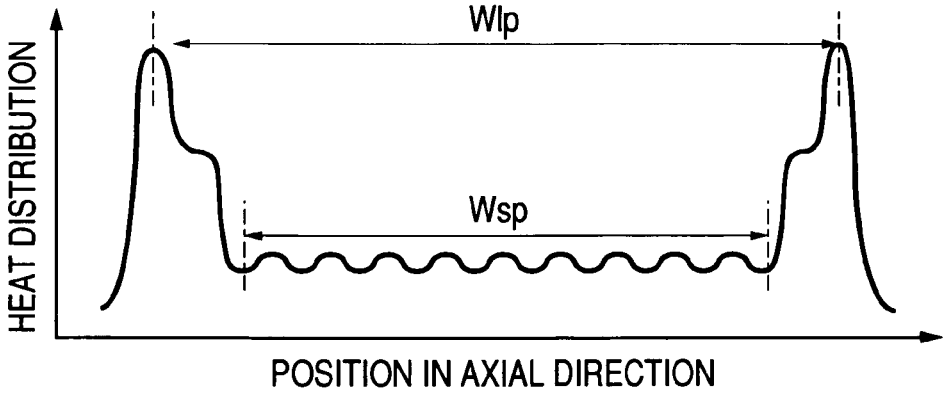
Figure 5:
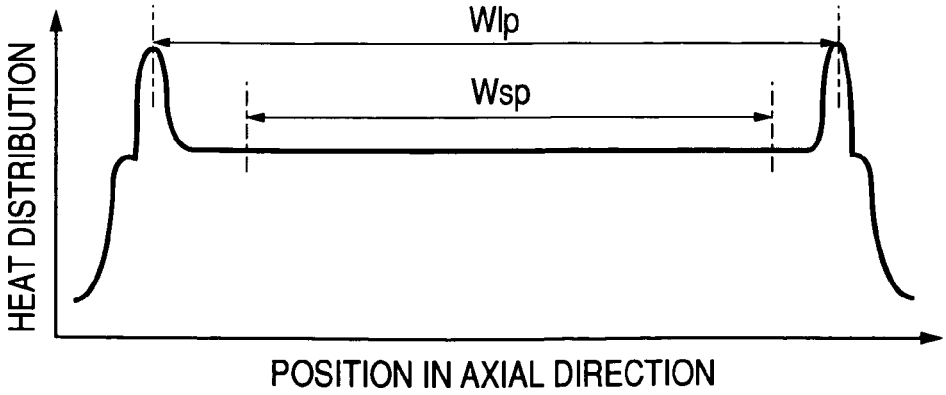
FIG. 5 is a typical chart showing a heat distribution obtained by the overlap of the first heater and the second heater in the fixing device according to the embodiment.
Figure 6:
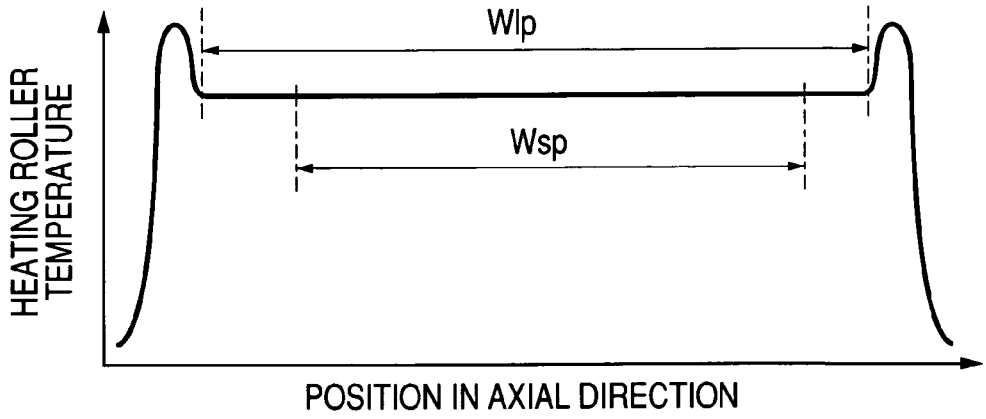
FIG. 6 is a typical chart showing the temperature distribution of a heating roller which is obtained immediately after the end of warm-up in the fixing device according to the embodiment.

Next, description will be given to the summary of the structure of each heater of the heating roller and a heat distribution thereof. There will be given the description in which the pressurizing roller and the belt corresponding to the embodiment shown in FIG. 2 are omitted. FIG. 3A is a typical view showing the schematic structure of a first heater in a fixing device according to the embodiment and FIG. 3B is a typical chart showing a heat distribution thereof, FIG. 4A is a typical view showing the schematic structure of a second heater in the fixing device according to the embodiment and FIG. 4B is atypical chart showing a heat distribution thereof, FIG. 5 is a typical chart showing a heat distribution obtained by the overlap of the first heater and the second heater in the fixing device according to the embodiment, and FIG. 6 is a typical chart showing the temperature distribution of a heating roller which is obtained immediately after the end of warm-up in the fixing device according to the embodiment.

In the fixing device according to the embodiment, two heaters are caused to correspond to two image regions, that is, a basic image region Wsp (for example, A5 in a transverse direction: 210 mm) and a maximum image region Wlp (for example, A3 in a vertical direction: 297 mm). Referring to the first heater to be the central region heating heater in the two heaters provided in the heating roller as described above, a coil filament 103 and a wire filament 104 are alternately provided by setting the basic image region Wsp to have a heat distribution, and furthermore, a holding portion filament 105 for holding the wire filament 104 is provided on the outside of the maximum image region Wlp by setting the inside of the maximum image region Wlp to have no heat distribution at an outside thereof as shown in FIG. 3A.

A light distribution is a distribution of a visible light. In the case in which a halogen lamp manufacturer measures the light distribution, it uses an apparatus for measuring the intensity of the visible light (a wavelength of 0.4 to 0.7 μm). However, the peak of the spectral distribution energy of a halogen lamp has a wavelength of 1.1 μm, and an infrared light greatly contributes to the heating value of the heating roller which is transmitted by heat radiation. In the embodiment, accordingly, the distribution of the infrared light obtained by an apparatus for measuring the intensity of the infrared light (0.7 to 100 μm) will be used as a heat distribution in the following manner. In some cases, the heat distribution is not coincident with the light distribution depending on the manufacturers. For example, also in the case in which the light distribution is 20%, the heat distribution is 40%.

The tungsten filament constituted by the coil filament 103, the wire filament 104 and the holding portion filament 105 is put in a quartz glass tube 101 and an inner lead wire 106 is connected to both side ends thereof, and both side ends are sealed with a sealing portion 107 and a support portion 108 and a gas is charged therein. An electrode to be electrically connected to the inner lead wire is present in the support portion 108 and an external power is connected to a portion shown in an arrow I, thereby supplying a predetermined power.

In the first heater, the heat distribution is increased in a position corresponding to the coil filament 103 and is reduced in a position corresponding to the wire filament 104 in the basic image region Wsp. Therefore, a ripple is formed on the heat distribution in the basic image region Wsp as shown in FIG. 3B. On the other hand, only the wire filament 104 is present in the maximum image region Wlp provided on the outside of the basic image region Wsp. For this reason, the heat distribution is rapidly reduced and the heat distribution peak corresponding to the holding portion filament 105 further gets out of the maximum image region Wlp.

Contrary to the first heater, referring to the second heater to be the side end region heating heater, the region having the heat distribution is placed on the outside of the basic image region Wsp in the maximum image region Wlp and the coil filament 103 and the wire filament 104 are alternately provided, and furthermore, the region having no heat distribution is placed in the basic image region Wsp and the holding portion filament 105 and the wire filament 104 are alternately provided as shown in FIG. 4A. In the same manner as the first heater, the tungsten filament constituted by the coil filament 103, the wire filament 104 and the holding portion filament 105 is put in the quartz glass tube 101 and the inner lead wire 106 is connected to both side ends thereof, and both side ends are sealed with the sealing portion 107 and the support portion 108 and a gas is charged therein. An electrode to be electrically connected to the inner lead wire 106 is present in the support portion 108 and an external power is connected to the portion shown in the arrow I, thereby supplying a predetermined power.

In the second heater, the heat distribution is slightly increased in a position corresponding to the holding portion filament 105 and is reduced in a position corresponding to the wire filament 104 in the basic image region Wsp on a central part. For this reason, a ripple is formed on the heat distribution in the basic image region Wsp as shown in FIG. 4B. On the other hand, a heat distribution peak corresponding to the coil filament 103 is present in the maximum image region Wlp. Heat is radiated from both side ends of the heating roller. Therefore, at least two coil filaments 103 are provided to cause the length of the outside to be greater than that of the inside, thereby increasing the heat distribution obtained by the coil filament 103 on the outside. Thus, the heat radiated from both side ends is compensated.

In the embodiment, both side ends of the maximum image region Wlp are caused to have the peak of heat distribution in the second heater and the outside of the maximum image region Wlp is caused to have the peak of heat distribution in the first heater for central region heating, thereby carrying out overlapping. During warm-up in which the fixing device is heated from a room temperature or a lower temperature than a fixing temperature in a standby state to a target temperature, the first heater and the second heater are turned ON by 100%. Consequently, the heat distribution obtained by the overlap of the first heater and the second heater is caused to have a peak on both side ends of the maximum image region Wlp as shown in FIG. 5.

The heat distribution is flat up to the slight inside of the maximum image region Wlp corresponding to a maximum image and side ends have a heat distribution peak for compensating the radiation of heat from the side ends of the heating roller. However, an excessive quantity of heat caused by the peak of the heat distribution on both side ends is radiated from both side ends of the heating roller and is thus offset. For this reason, the temperature distribution of the heating roller which is obtained immediately after the end of the warm-up is almost flat over the whole maximum image region Wlp corresponding to the maximum image as shown in FIG. 6 and an excessive quantity of heat generated by the holding portion filament of the first heater raises the surface temperature of the heating roller so that a peak is formed on the outside of the maximum image region Wlp. Even if fixing for a paper having a maximum size in the maximum image region Wlp is carried out immediately after the warm-up, accordingly, a fixed image is not influenced but an excellent fixed image can be obtained.

According to the combination of the first heater and the second heater, the holding portion filament of the first heater is utilized for compensating the radiation of the heat from both side ends of the heating roller. As compared with the case in which the holding portion filament is not utilized, therefore, the consumed power of the second heater can be reduced by 10% to 40%. For example, when the warm-up is carried out over a fixing device including a heating roller having a core $\phi$ of 27 mm, a thickness of 0.7 mm and a rubber thickness of 0.95 mm by means of a first heater of 600 W and a second heater of 450 W, 10% of heat is taken out by a natural convection, 30 to 40% of heat is radiated from both side ends of the heating roller through a support metal plate and a driving gear, and 50 to 60% of heat is used for the warm-up. In order to compensate the heat radiated from both side ends of the heating roller, accordingly, both side ends of the second heater are provided with a heat distribution peak of 110 to 160%.

Figure 7A:
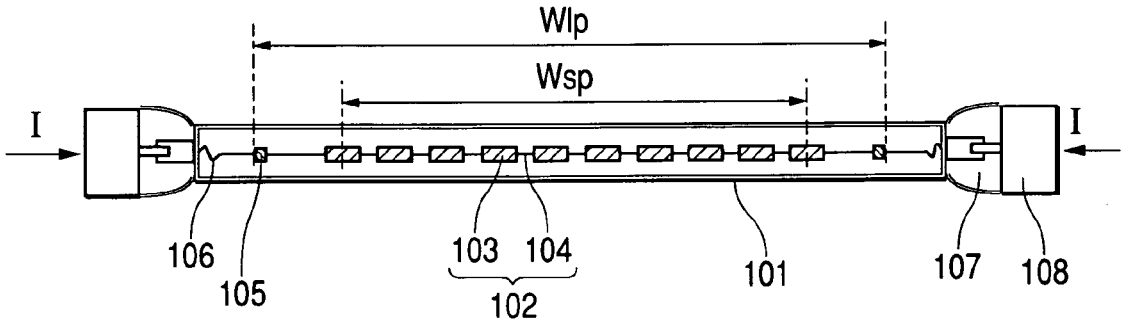
FIG. 7A is a view showing an example of the schematic structure of a first heater in a fixing device according to a comparative example and FIG. 7B is a chart showing an example of a heat distribution thereof.

Next, description will be given to a comparative example with the fixing device according to the embodiment. FIG. 7A is a view showing the schematic structure of a first heater of a fixing device according to the comparative example and FIG. 7B is a chart showing an example of a heat distribution, FIG. 8 is a chart showing an example of the heat distribution in which the first heater and a second heater in the fixing device according to the comparative example are caused to overlap with each other, and FIG. 9 is a chart showing an example of the temperature distribution of a heating roller which is obtained immediately after the end of the warm-up in the fixing device according to the comparative example.

Figure 7B:
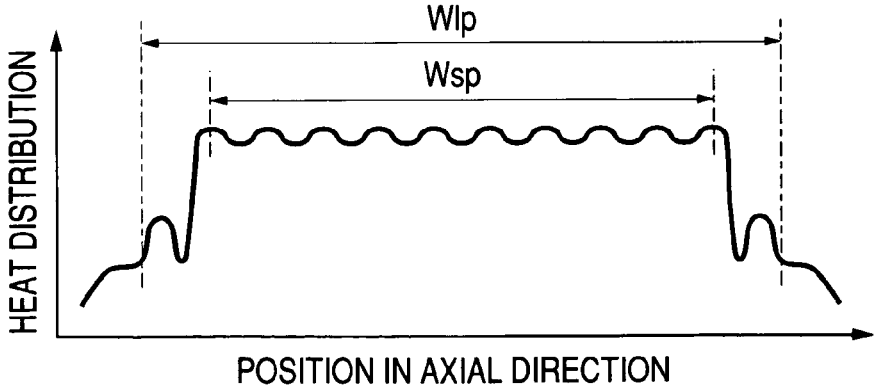

As the comparative example, in the first heater in which the coil filament 103 and the wire filament 104 are provided alternately in the basic image region Wsp and the holding portion filament 105 is provided on the both outsides of the basic image region Wsp and on the inside of the maximum image region Wlp as shown in FIG. 7A, a heat distribution is increased in a position corresponding to the coil filament 103 in the basic image region Wsp and is reduced in a position corresponding to the wire filament 104 therein so that a ripple is formed as shown in FIG. 7B. On the both outsides of the basic image region Wsp, moreover, a heat distribution peak is formed on the inside of the maximum image region Wlp corresponding to the holding portion filament 105.

Figure 8:
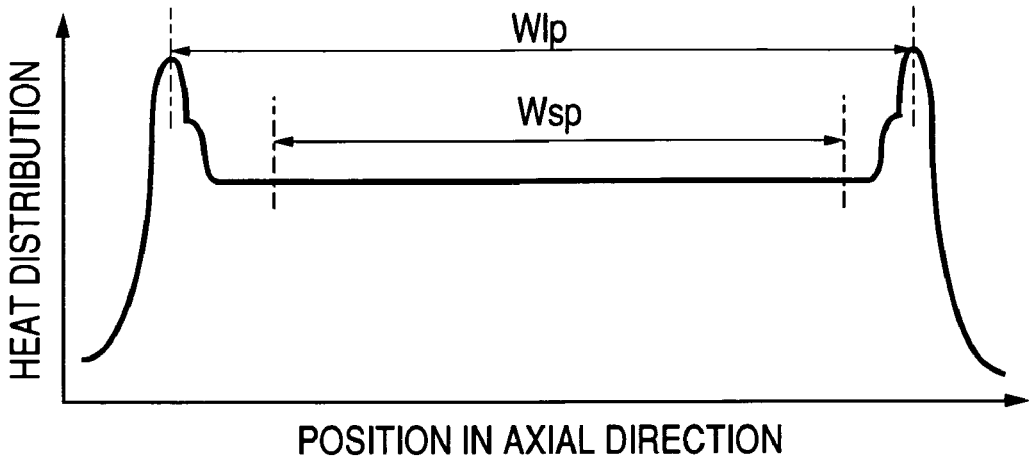
FIG. 8 is a chart showing an example of a heat distribution obtained by the overlap of the first heater and a second heater in the fixing device according to the comparative example.
Figure 9:
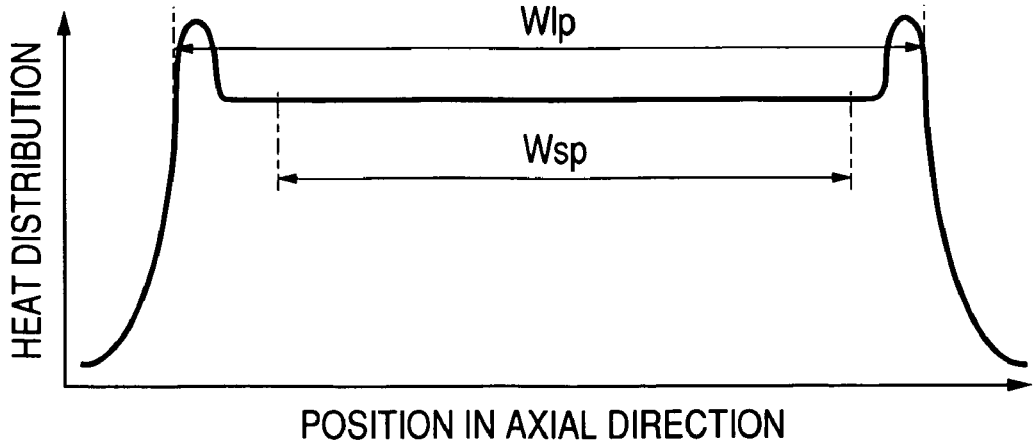
FIG. 9 is a chart showing an example of the temperature distribution of a heating roller which is obtained immediately after the endo f warm-up in the fixing device according to the comparative example.

For this reason, when the first heater and the second heater shown in FIGS. 4A and 4B are caused to overlap with each other, a heat distribution peak appears by the second heater on both side ends of the maximum image region Wlp and appears like a shoulder by the first heater on an inside thereof, and an inside thereof has a flat heat distribution as shown in FIG. 8 during warm-up. The heat distribution peak on both side ends of the maximum image region Wlp compensates the radiation of heat from both side ends of the heating roller and the shoulder of the heat distribution peak remains on the inside thereof. As a result, in the temperature distribution of the heating roller which is obtained immediately after the end of the warm-up, an excessive quantity of heat obtained by the holding portion filament 105 of the first heater raises the surface temperature of the heating roller so that a temperature peak is formed in the maximum image region Wlp as shown in FIG. 9.

Figure 10:
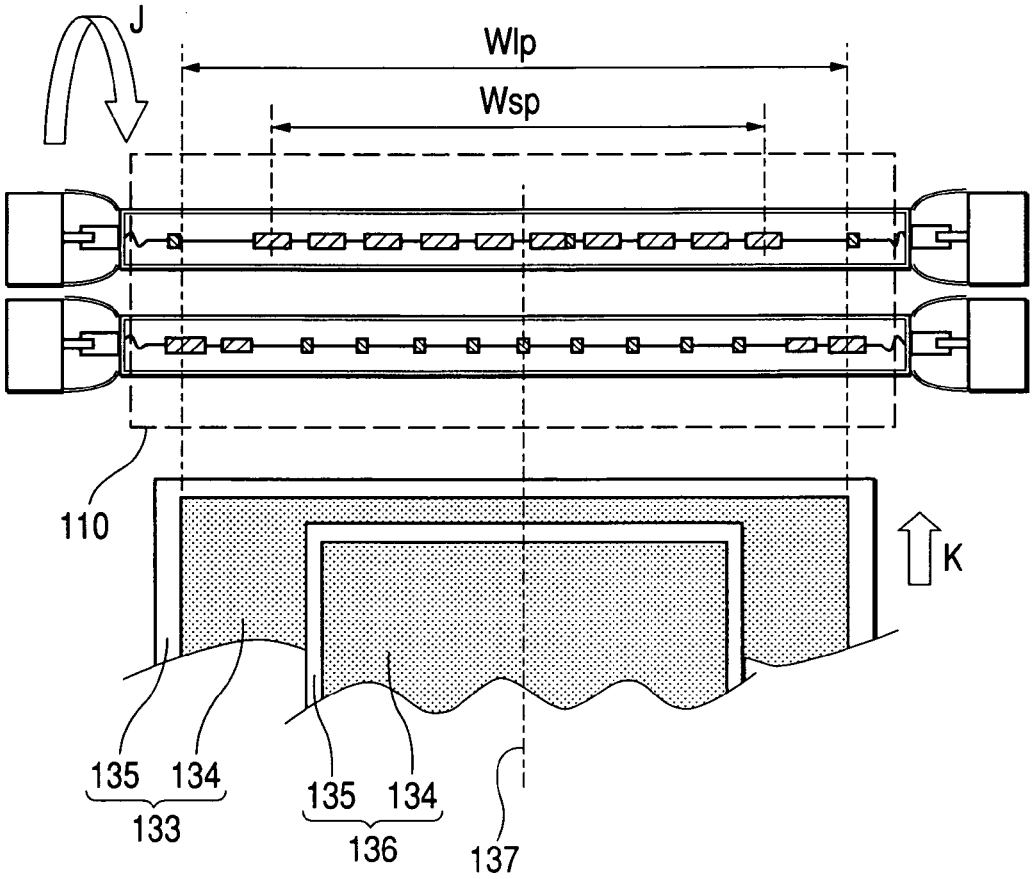
FIG. 10 is a view for explaining a paper passing state.
Figure 11:
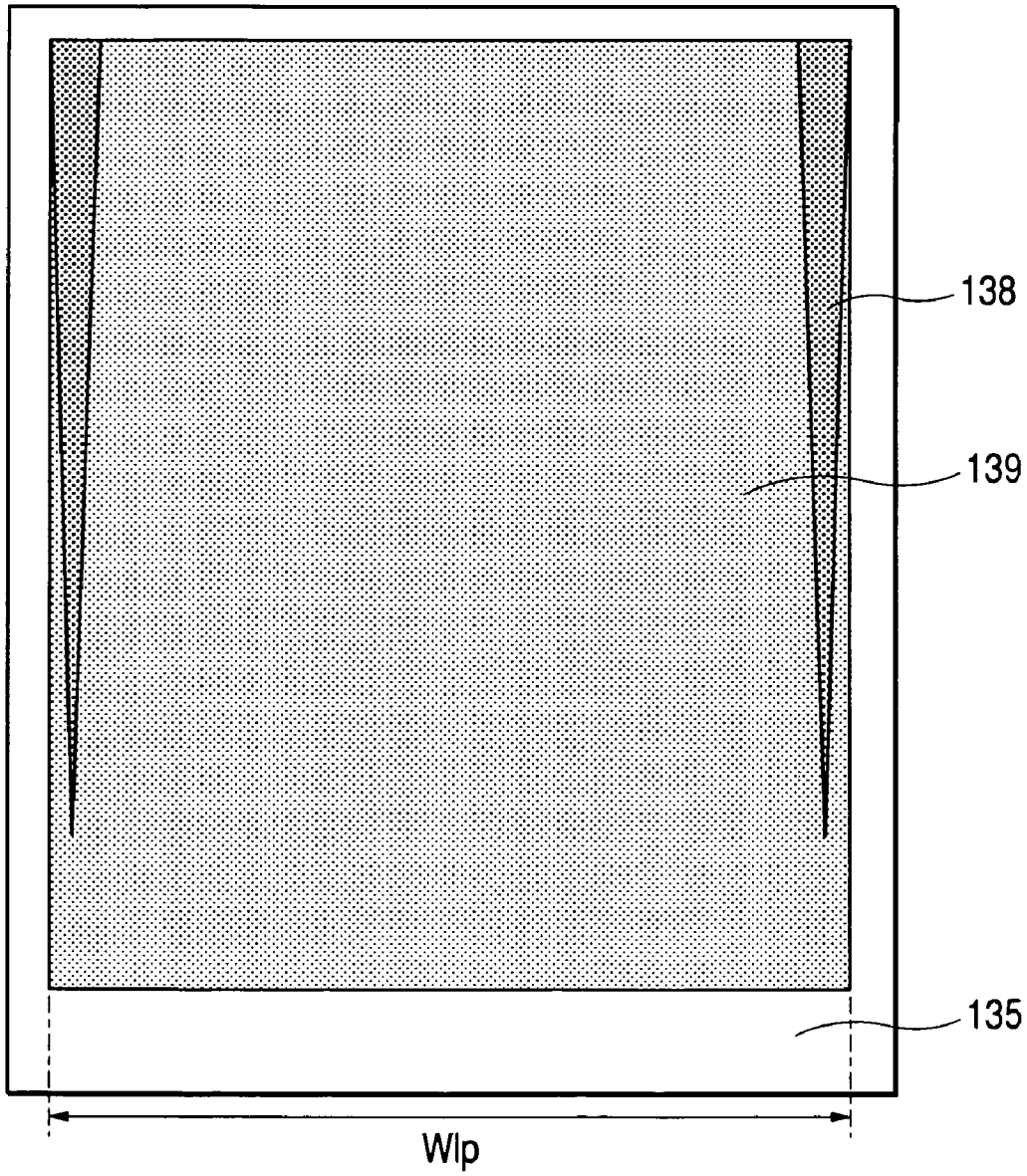
FIG. 11 is a view showing an example of an image gloss unevenness.

Description will be given to an image gloss unevenness caused by the passage of a paper. FIG. 10 is a view for explaining a paper passing state and FIG. 11 is a view showing an example of the image gloss unevenness.

Next, description will be given to a difference in an image which is made in the case in which the halogen lamps shown in FIG. 3A, 3B, or 7 and FIGS. 4A and 4B are provided in the heating roller of the fixing device shown in FIG. 1 or 2. As shown in FIG. 10, the halogen lamps shown in FIGS. 3A, 3B, 4A and 4B were provided as the first and second heaters in the heating roller of the fixing device shown in FIG. 1 or 2 (a contour shown in a thick dotted line of the drawing) respectively, and they were maintained at a high temperature and were rotated in a direction of an arrow J, and a paper 133 having a maximum size or a paper 136 having a smaller size was caused to pass in a direction of an arrow K and a whole gray and solid unfixed image formed thereon was fixed. Immediately after the end of the warm-up, similarly, an excellent solid fixed image could be obtained. When the first heater was replaced with the halogen lamp shown in FIGS. 7A and 7B and the paper 133 having a maximum size in the maximum image region Wlp was caused to pass immediately after the end of the warm-up, however, a high gloss region 138 appeared on both side ends of an image and a gloss unevenness was generated as shown in FIG. 11. At this time, the heating roller had the temperature distribution shown in FIG. 9.

The invention is not restricted to the above embodiment but various modifications can be made. For example, while the outside of the maximum image region is caused to have the peak of the heat distribution by the holding portion filament of the first heater in the embodiments, both side ends of the maximum image region may have the peak of the heat distribution.

A modification of the above embodiment is described below with reference to FIGS. 12A to 21.

Figure 12A:
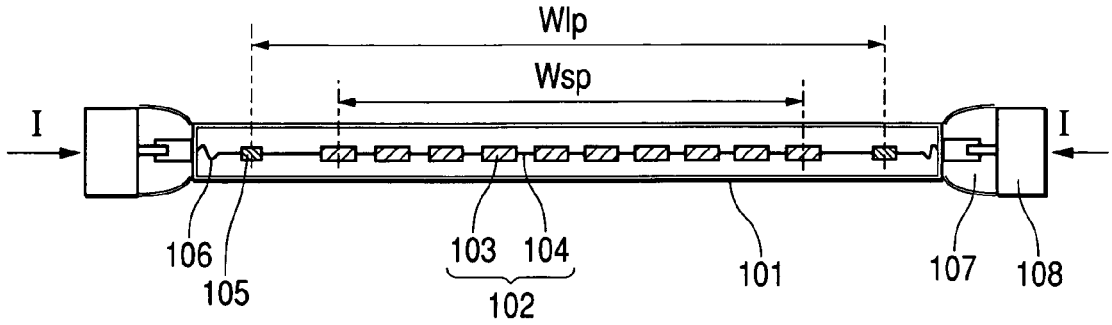
FIG. 12A is a schematic view showing the structure of a first heater in the fixing device according to a modification of the embodiment and FIG. 12B is a typical chart showing a heat distribution thereof.

In the fixing device according to this modification, a holding portion filament 105 for holding the wire filament 104 is provided on both side ends by setting the inside of the maximum image region Wlp to have no heat distribution at an outside thereof as shown in FIG. 12A.

Figure 12B:
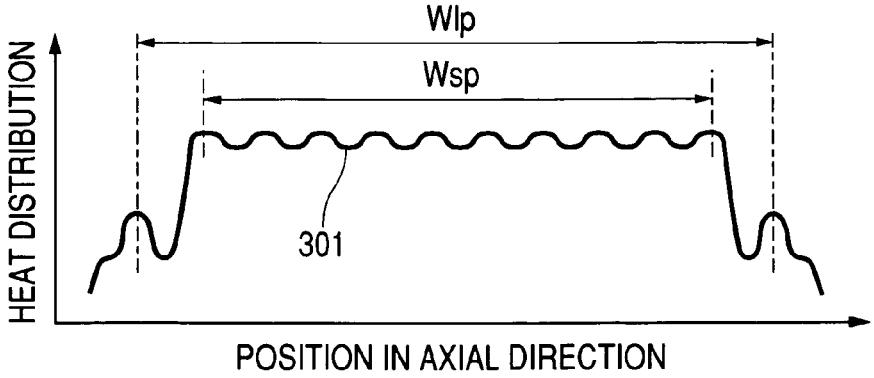

In the first heater of the modification, the heat distribution is increased in a position corresponding to the coil filament 103 and is reduced in a position corresponding to the wire filament 104 in the basic image region Wsp. Therefore, a ripple 301 is formed on the heat distribution in the basic image region Wsp as shown in FIG. 12B. On the other hand, only the wire filament 104 is present in the maximum image region Wlp provided on the outside of the basic image region Wsp. For this reason, the heat distribution is rapidly reduced and the heat distribution peak corresponding to the holding portion filament 105 comes to both side ends.

Figure 13A:
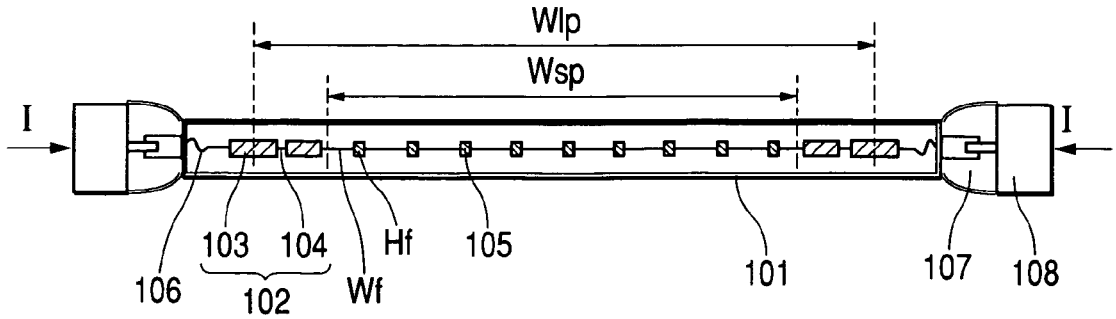
FIG. 13A is a schematic view showing the structure of a second heater in the fixing device according to the embodiment and FIG. 13B is a typical chart showing a heat distribution thereof.
Figure 13B:
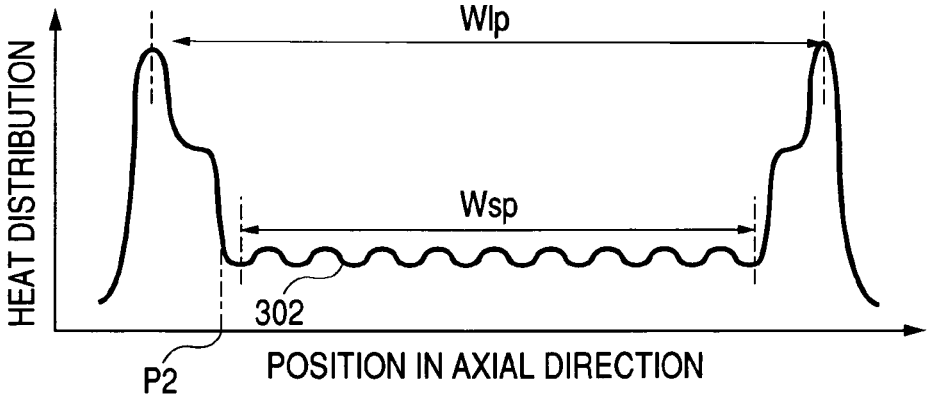

Similarly to the embodiment of FIGS. 4A and 4B, referring to the second heater to be the side end region heating heater, the region having the heat distribution is placed on the outside of the basic image region Wsp in the maximum image region Wlp and the coil filament 103 and the wire filament 104 are alternately provided, and furthermore, the region having no heat distribution is placed in the basic image region Wsp and the holding portion filament 105 and the wire filament 104 are alternately provided as shown in FIGS. 13A and 13B.

In the second heater of the modification, the heat distribution is slightly increased in a position corresponding to the holding portion filament 105 and is reduced in a position corresponding to the wire filament 104 in the basic image region Wsp on a central part. For this reason, a ripple 302 is formed on the heat distribution in the basic image region Wsp as shown in FIG. 8B. On the other hand, a heat distribution peak corresponding to the coil filament 103 is present in the maximum image region Wlp. Heat is radiated from both side ends of the heating roller. Therefore, at least two coil filaments 103 are provided to cause the length of the outside to be greater than that of the inside, thereby increasing the heat distribution obtained by the coil filament 103 on the outside. Thus, the heat radiated from both side ends is compensated.

Figure 14:
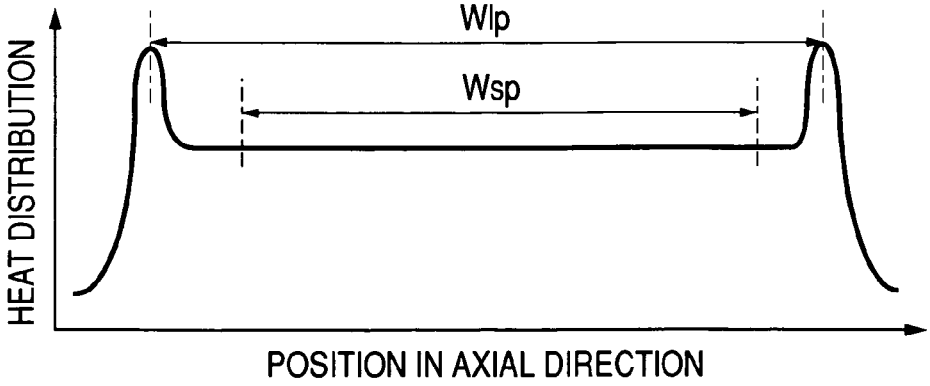
FIG. 14 is a typical chart showing a heat distribution obtained by the overlap of the first heater and the second heater in the fixing device according to the embodiment.

In the modification, the peak of heat distribution in the first heater for central region heating is caused to overlap with the peak of heat distribution in the second heater, and the first heater and the second heater are turned ON by 100% during warm-up in which the fixing device is heated from a room temperature or a lower temperature than a fixing temperature in a standby state to a target temperature. Consequently, the heat distribution obtained by the overlap of the first heater and the second heater is caused to have a peak on both side ends of the maximum image region Wlp as shown in FIG. 14.

Figure 15:
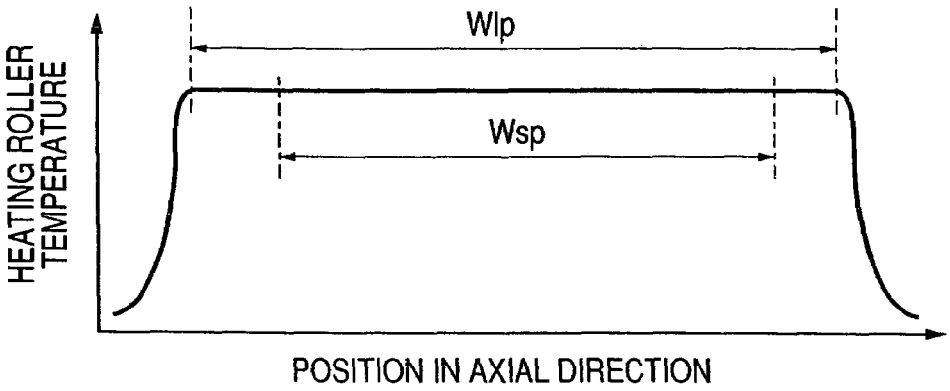
FIG. 15 is a typical chart showing the temperature distribution of a heating roller which is obtained immediately after the end of warm-up in the fixing device according to the embodiment.

The heat distribution is flat up to the slight inside of the maximum image region Wlp corresponding to a maximum image and both side ends have a heat distribution peak for compensating the radiation of heat from both side ends of the heating roller. However, an excessive quantity of heat caused by the peak of the heat distribution on both side ends is radiated from both side ends of the heating roller and is thus offset. For this reason, the temperature distribution of the heating roller which is obtained immediately after the end of the warm-up is almost flat over the whole maximum image region Wlp corresponding to the maximum image as shown in FIG. 15. When a paper having a maximum size in the maximum image region Wlp is fixed immediately after the warm-up, accordingly, an excellent fixed image can be obtained.

Figure 16:
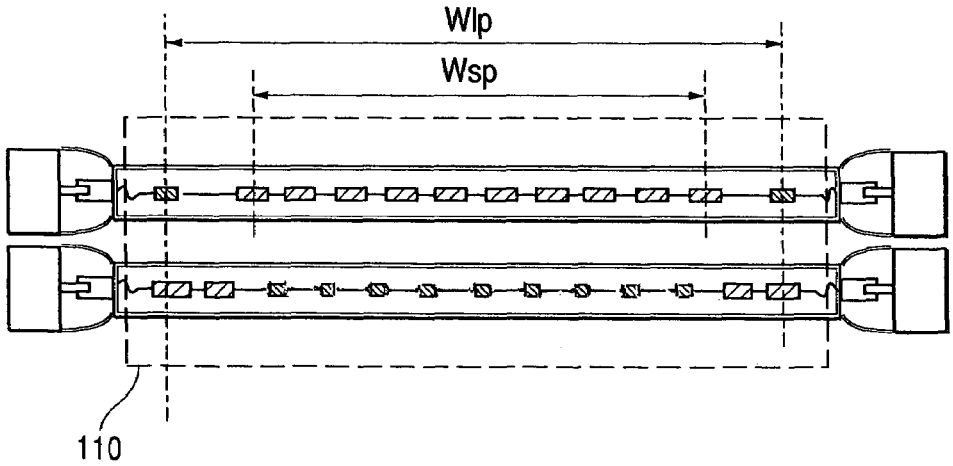
FIG. 16 is a view for explaining a heating roller including the first heater and the second heater in combination.

Further, in this modification, the wire filament of the second heater and the wire filament of the first heater are provided in a position corresponding to the coil filament of the first heater and in a position corresponding to the holding portion filament of the second heater in the basic image region Wsp respectively and are provided in the heating roller 110 as shown in FIG. 16. In other words, the holding portion filament and the wire filament in the second heater are provided with phases alternated with those of the coil filament and the wire filament in the first heater which are provided alternately in the central region. Consequently, there are offset the ripple 301 of the heat distribution of the first heater shown in FIG. 12B and the ripple 302 of the heat distribution of the second heater shown in FIG. 12B which are formed in the basic image region Wsp.

In the present modification, furthermore, the peak of heat distribution in the first heater for central region heating is caused to overlap with the peak of heat distribution in the second heater at both side ends of the maximum image region Wlp, and the first heater and the second heater are turned ON by 100% during warm-up in which the fixing device is heated from a room temperature or a lower temperature than a fixing temperature in a standby state to a target temperature. Consequently, the heat distribution obtained by the overlap of the first heater and the second heater has a peak on both side ends of the maximum image region Wlp as shown in FIG. 17.

Figure 17:
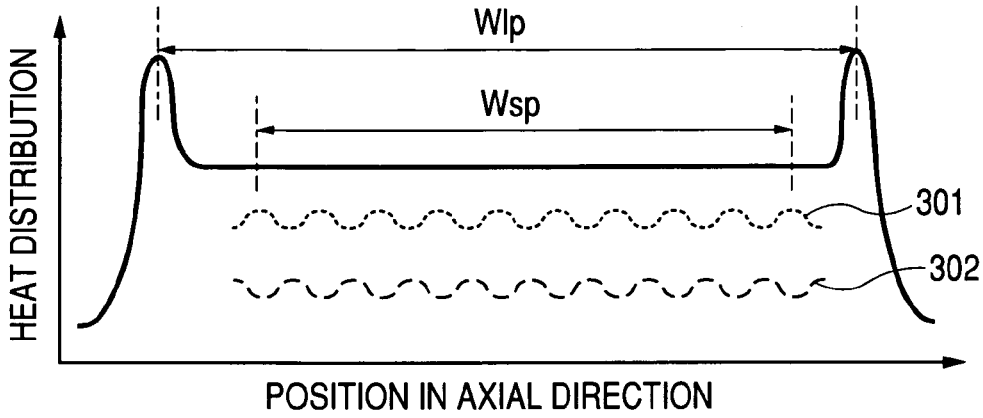
FIG. 17 is atypical chart showing a heat distribution obtained by the overlap of the first heater and the second heater in the fixing device according to the embodiment.

In the heat distribution, phases are alternated with each other as shown in the heat distribution ripple 301 of the first heater and the heat distribution ripple 302 of the second heater in FIG. 17. Therefore, the heat distribution ripples are offset so that the heat distribution in the basic image region Wsp is flattened. Furthermore, both side ends have the peak of heat distribution for compensating the radiation of heat from both side ends of the heating roller. However, an excessive quantity of heat caused by the peak of heat distribution is radiated from both side ends of the heating roller and is thus offset. For this reason, the temperature distribution of the heating roller which is obtained immediately after the end of the warm-up is almost flat over the whole maximum image region Wlp corresponding to the maximum image as shown in FIG. 15. When fixing for a paper having a maximum size in the maximum image region Wlp is carried out immediately after the warm-up, accordingly, an excellent fixed image can be obtained.

Figure 18:
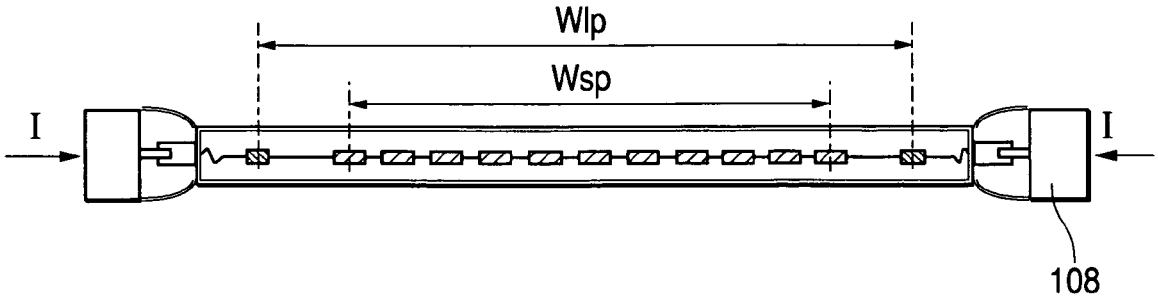
FIG. 18 is a view showing an example of the schematic structure of a first heater in a fixing device according to a comparative example.
Figure 19A:
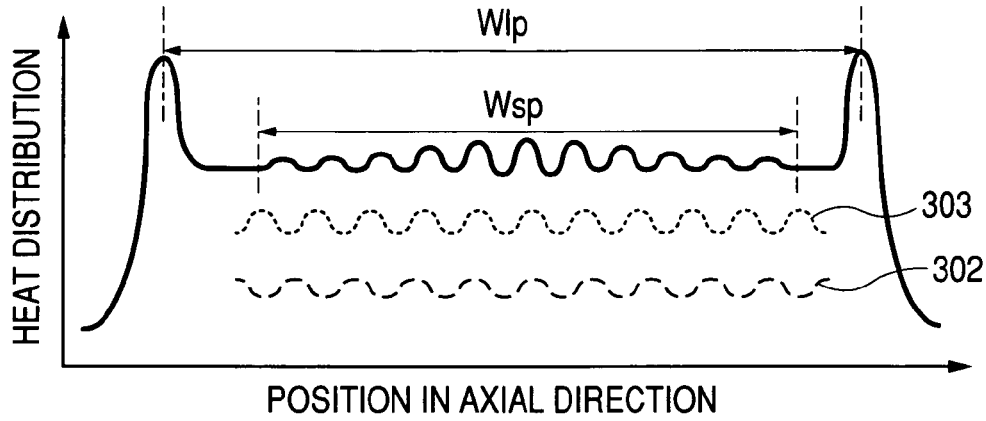
FIG. 19A is a chart showing an example of a heat distribution obtained by the overlap of the first heater and a second heater in the fixing device according to the comparative example and FIG. 19B is a chart showing an example of the temperature distribution of a heating roller which is obtained immediately after the end of warm-up.
Figure 19B:
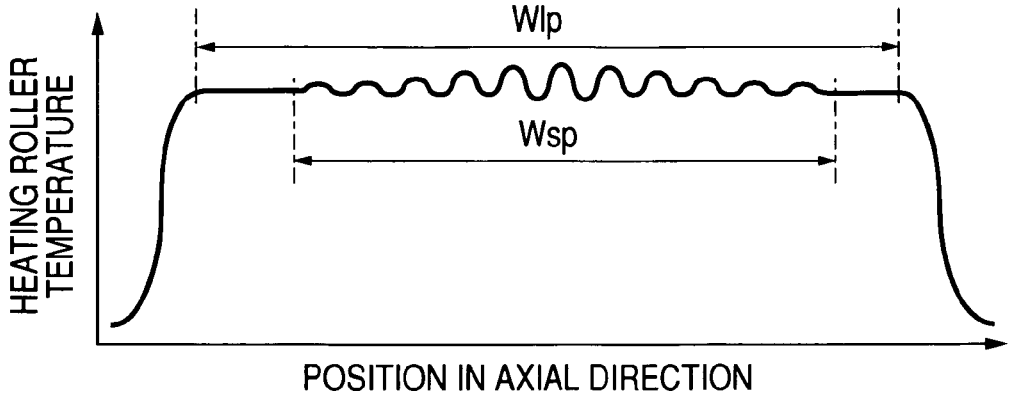
Figure 20:
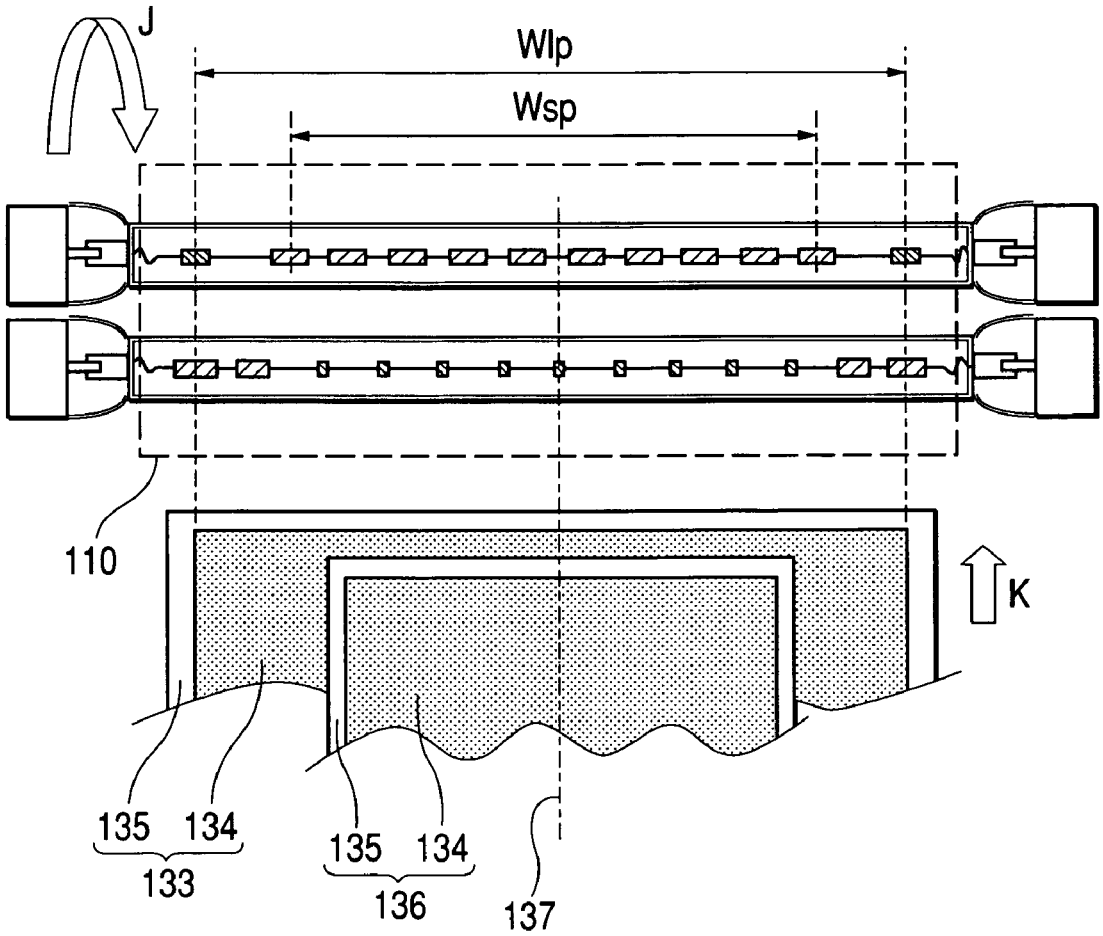
FIG. 20 is a view for explaining a paper passing state.

Next, description will be given to a comparative example with the fixing device according to the modification. FIG. 18 is a view showing the schematic structure of a first heater in a fixing device according to the comparative example, and FIG. 19A is a chart showing an example of a heat distribution obtained by the overlap of the first heater and a second heater in the fixing device according to the comparative example and FIG. 19B is a chart showing an example of the temperature distribution of a heating roller obtained immediately after the end of warm-up.

As the comparative example, in FIG. 18, the number of the coil filaments 103 provided alternately with the wire filaments 104 in the basic image region Wsp is greater than that in the first heater shown in FIGS. 12A and 12B. For this reason, when the first heater and the second heater shown in FIGS. 13A and 13B are caused to overlap with each other, the holding filament and the wire filament in the second heater are not provided to have phases alternated with those of the coil filament and the wire filament in the first heater but the phases are shifted from each other so that the overlapping region of the coil filament of the first heater and the holding filament of the second heater is formed. A ripple is formed in the basic image region Wsp as shown in FIG. 19A together with a heat distribution ripple 303 of the first heater and the heat distribution ripple 302 of the second heater. In addition, a greater heat distribution ripple than heat distribution ripples appearing singly in the first and second heaters is formed in the vicinity of a center. As a result, also in the temperature distribution of the heating roller which is obtained immediately after the end of warm-up, a temperature ripple corresponding to the heat distribution ripple shown in FIG. 19A appears in the basic image region Wsp as shown in FIG. 19B.

Figure 21:
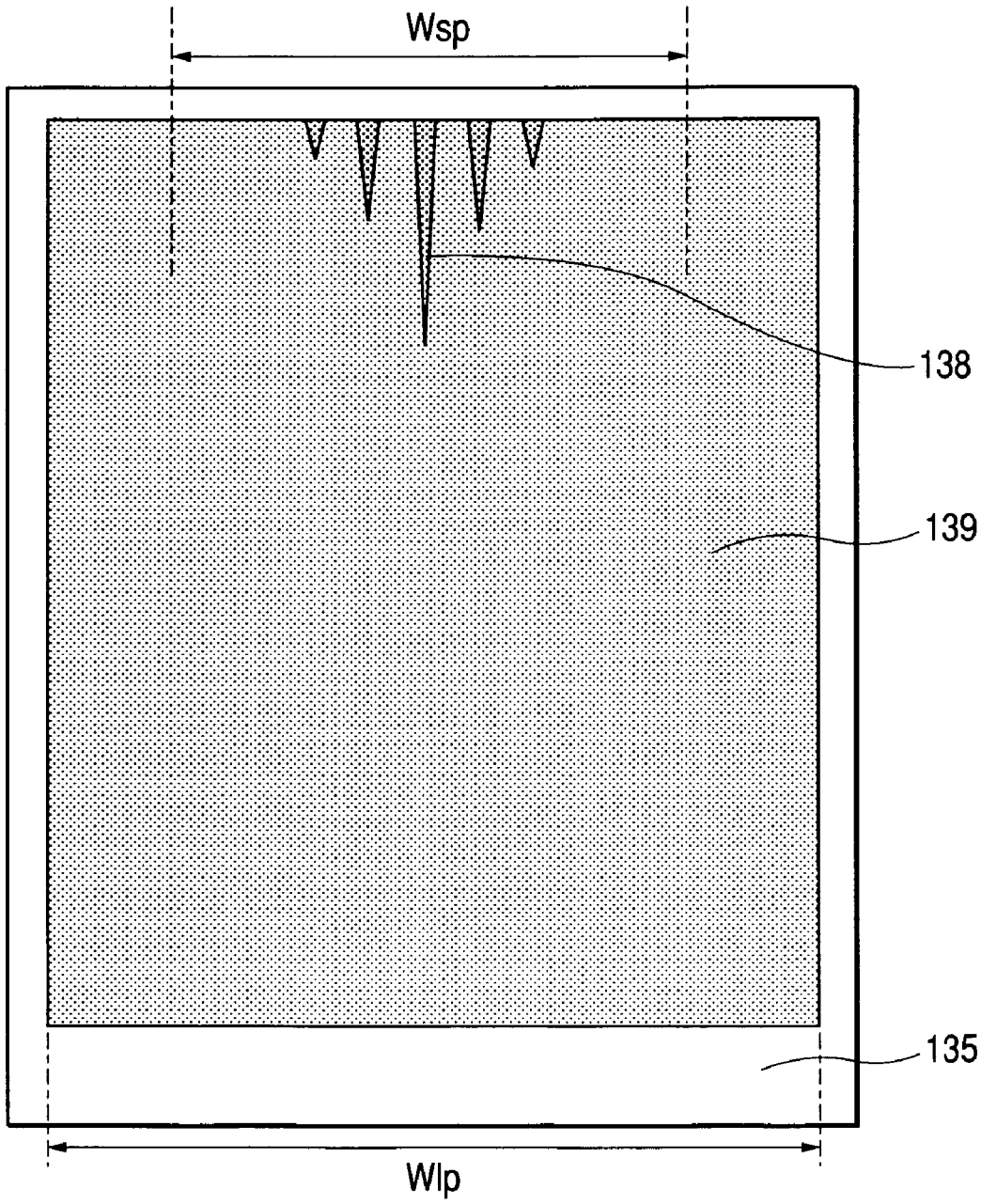
FIG. 21 is a view showing an example of an image gloss unevenness.

Next, description will be given to a difference in an image which is made in the case in which the halogen lamps shown in FIG. 12A, 12B or 18 and FIGS. 13A and 13B are provided in the heating roller of the fixing device shown in FIG. 1 or 2. As shown in FIG. 10, the halogen lamps shown in FIGS. 12A, 12B, 13A and 13B were provided as the first and second heaters in the heating roller of the fixing device shown in FIG. 1 or 2 (a contour shown in a thick dotted line of the drawing) respectively, and they were maintained at a high temperature and were rotated in a direction of an arrow J, and a paper 133 having a maximum size or a paper 136 having a smaller size was caused to pass in a direction of an arrow K and a whole gray and solid unfixed image formed thereon was fixed. Immediately after the end of the warm-up, similarly, an excellent solid fixed image could be obtained. When the first heater was replaced with the halogen lamp shown in FIG. 18 and the paper 133 having a maximum size in the maximum image region Wlp was caused to pass immediately after the end of the warm-up, however, a high gloss region 138 appeared from a central part toward both sides corresponding to the temperature ripple as shown in FIG. 21 so that a gloss unevenness was generated. At this time, the heating roller had the temperature distribution shown in FIG. 19B.

Next, description will be given to the control of the heater and a change in the temperature. In a standby mode, the first heater turns ON/OFF the halogen lamp at a duty of approximately 10% in order to compensate heat radiation caused by a natural convection, thereby holding the central part of the heating roller at a high temperature. Moreover, the second heater turns ON/OFF the halogen lamp at a duty of 30 to 40% in order to compensate heat radiation from both side ends of the heating roller.

On the other hand, in the case in which a thin paper of A4 in a transverse direction is caused to continuously pass, a temperature is raised by approximately 10° C. at the non-paper passing end of the heating roller when the first heater is turned ON/OFF at a duty of 15% and the second heater is turned ON/OFF at a duty of 35 to 45%. In the case in which a plain paper of A4 in the transverse direction is caused to continuously pass, the temperature is raised by approximately 20° C. at the non-paper passing end of the heating roller when the first heater is turned ON/OFF at a duty of 20% and the second heater is turned ON/OFF at a duty of 40 to 50%.

Figure 22:
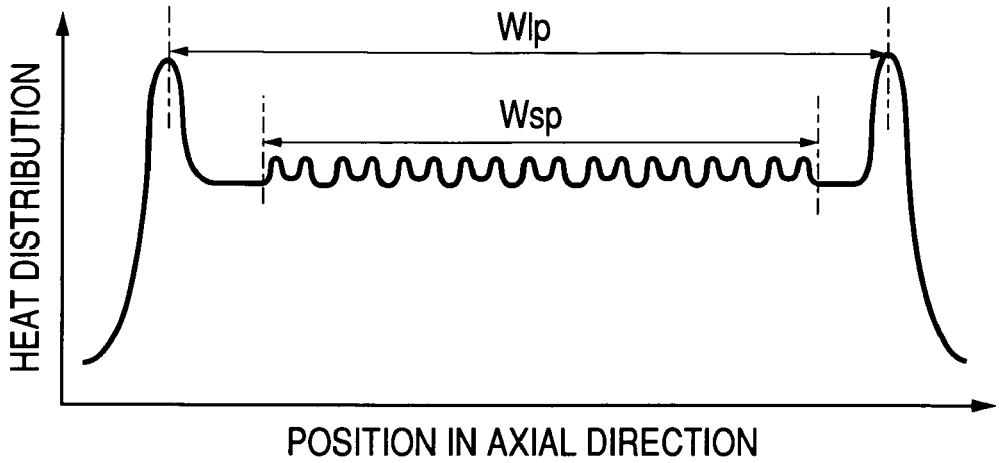
FIG. 22 is a typical chart showing a heat distribution obtained by the overlap of the first heater and the second heater in the fixing device according to the embodiment.
Figure 23:
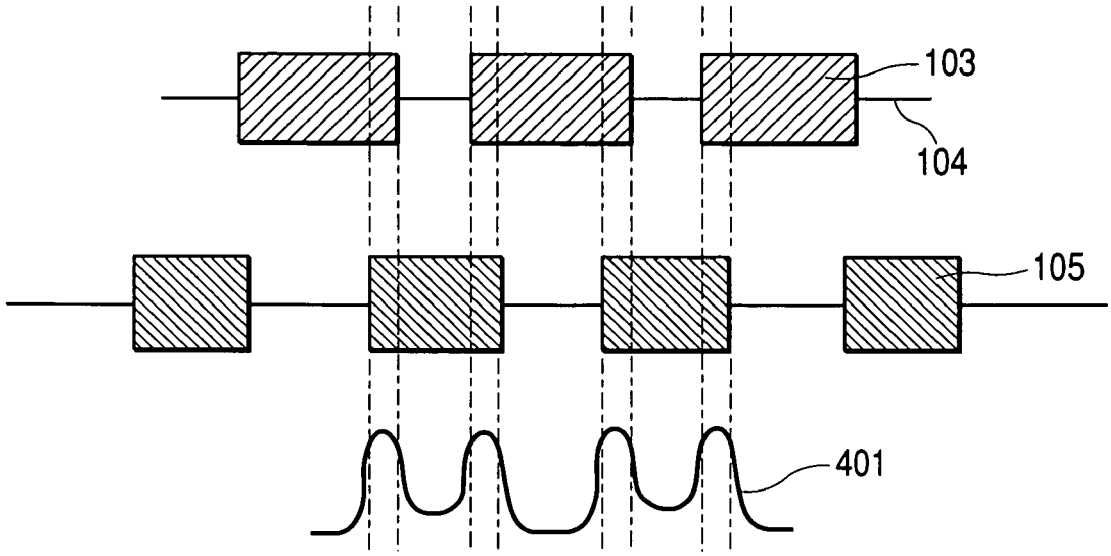
FIG. 23 is a view showing the positional relationship between a filament and a heat distribution ripple in a basic image region Wsp.

In the above modification, furthermore, the peak of the heat distribution on both side ends of the first heater for central region heating is caused to overlap with the peak of the heat distribution on both side ends of the second heater at both side ends of the maximum image region Wlp, and the first heater and the second heater are turned ON by 100% during warm-up in which the fixing device is heated from a room temperature or a lower temperature than a fixing temperature in a standby state to a target temperature. Consequently, the heat distribution obtained by the overlap of the first heater and the second heater has a peak on both side ends of the maximum image region Wlp as shown in FIG. 22. Furthermore, it is possible that a heat distribution ripple 401 having, as a heat distribution peak, a region in which the coil filament 103 of the first heater and the holding portion filament 105 of the second heater overlap with each other is generated in the basic image region Wsp as shown in FIG. 23.

Figure 24:
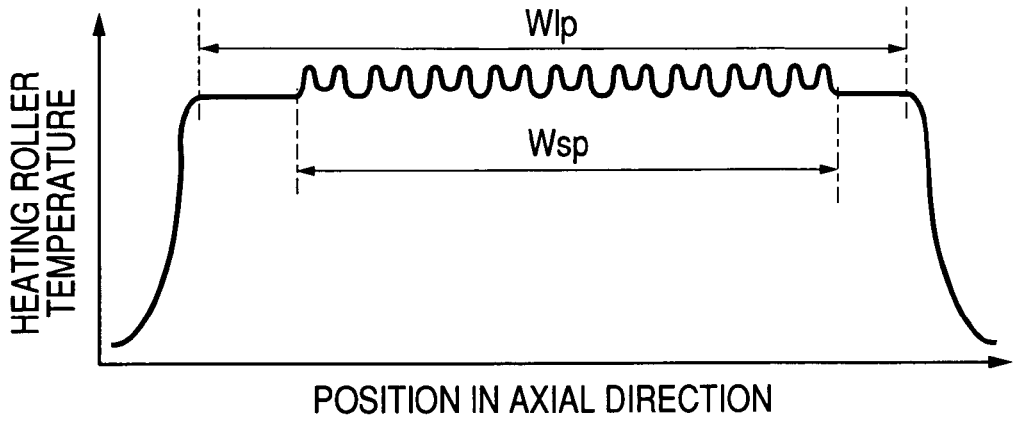
FIG. 24 is a typical chart showing the temperature distribution of the heating roller which is obtained immediately after the end of warm-up.

Even in the above heat distribution, both side ends have the peak of a heat distribution for compensating the radiation of heat from both side ends of the heating roller. However, an excessive quantity of heat caused by the peak of the heat distribution on both side ends is radiated from both side ends of the heating roller and is thus offset. For this reason, the temperature distribution of the heating roller which is obtained immediately after the end of the warm-up is almost flat over the whole maximum image region Wlp corresponding to the maximum image as shown in FIG. 24. When fixing for a paper having a maximum size in the maximum image region Wlp is carried out immediately after the warm-up, accordingly, an excellent fixed image can be obtained.

Figure 25:
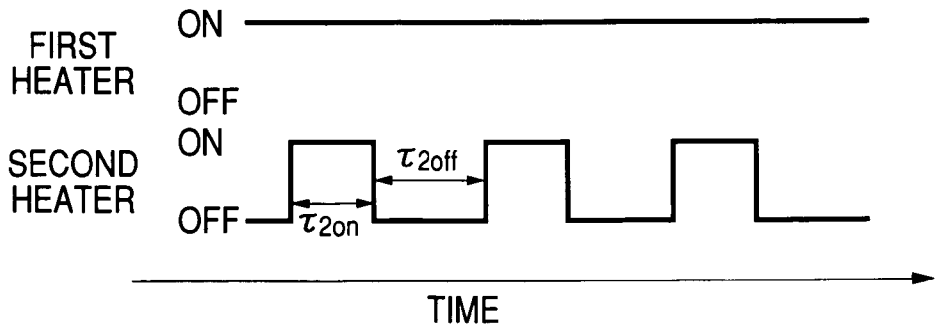
FIG. 25 is a chart for explaining an ON/OFF duty.
Figure 26A:
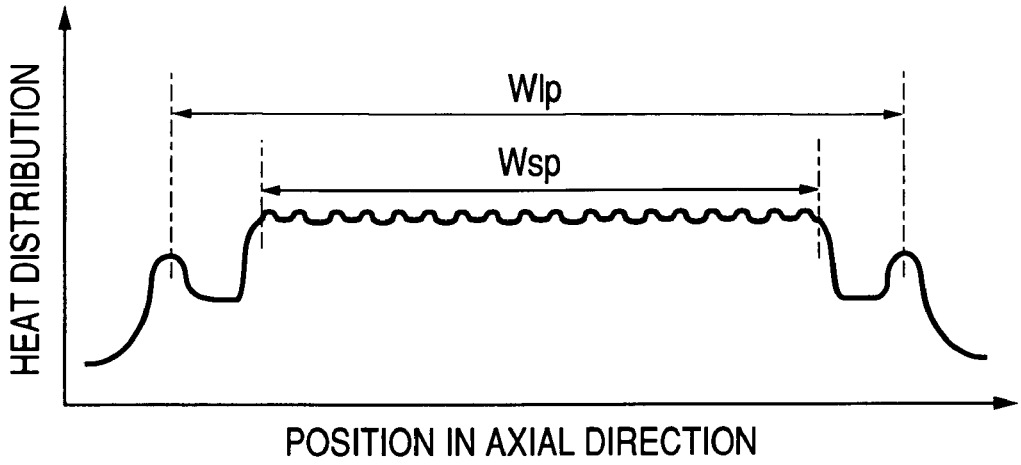
FIGS. 26A and 26B are typical charts showing the heat distribution for the overlap of the first heater and the second heater which is obtained during the passage of a thick paper having a small size and the temperature distribution of the heating roller which is obtained during the passage of the thick paper having the small size, respectively.
Figure 26B:
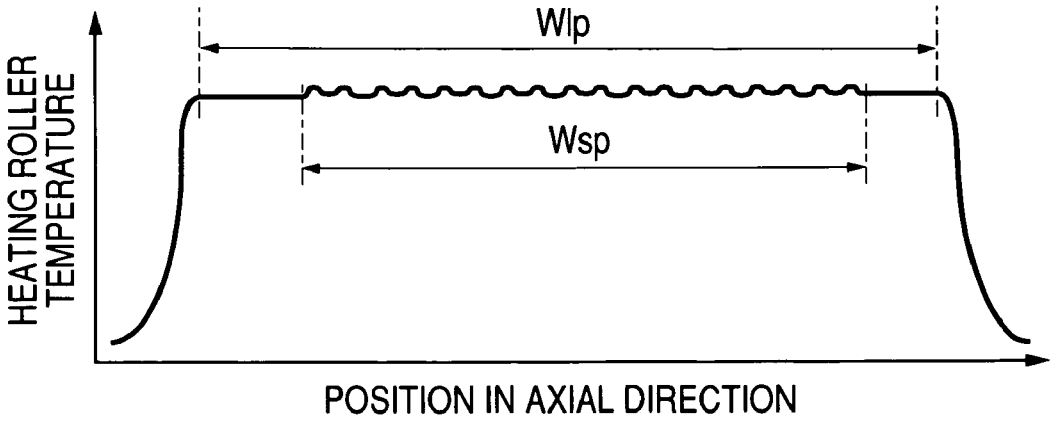

FIG. 25 is a chart for explaining an ON/OFF duty, and FIGS. 26A and 26B are typical charts showing the heat distribution for the overlap of the first heater and the second heater which is obtained during the passage of a thick paper having a small size and the temperature distribution of the heating roller which is obtained during the passage of the thick paper having the small size, respectively.

In the fixing device according to the embodiment, a paper has various thicknesses and sizes. When a thick paper having a smaller width than that of the basic image region Wsp is to pass, the ON/OFF duty of the first heater is increased and that of the second heater is reduced. More specifically, since a large amount of heat is taken away from the first heater by the thick paper, a high ON/OFF duty is required. Since it is sufficient that the second heater compensates the heat radiation from both side ends of the heating roller, a low ON/OFF duty is enough.

For example, in the case in which a 163 ($g/m^2$) paper having the same width as that of the basic image region Wsp and a great thickness is caused to continuously pass, the first heater is turned ON at a full capacity (a duty of 100%) on an average as shown in FIG. 25 and the second heater is ON/OFF controlled at a duty of 30%. At this time, FIG. 26A shows a heat distribution which is time averaged with the overlap of the first heater and the second heater, in which 30% of the heat distribution of the second heater shown in FIG. 13B is added to 100% of the heat distribution of the first heater shown in FIG. 12B. Accordingly, the heat distribution peak appearing on both side ends of the maximum image region Wlp is also smaller than the heat distribution peak shown in FIG. 22, and the heat distribution within the basic image region Wsp is also reduced on an inside thereof. At this time, the temperature distribution of the heating roller which is time averaged is obtained as shown in FIG. 26B, and a temperature ripple in the basic image region Wsp is smaller than the temperature ripple shown in FIG. 24.

Figure 27:
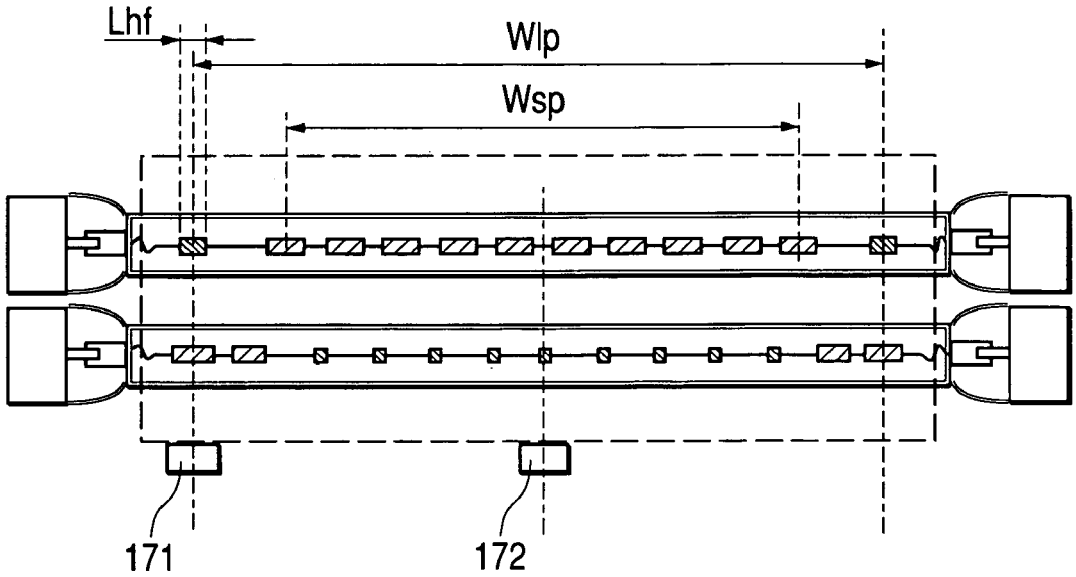
FIG. 27 is a view for explaining the position of a temperature sensor.
Figure 30:
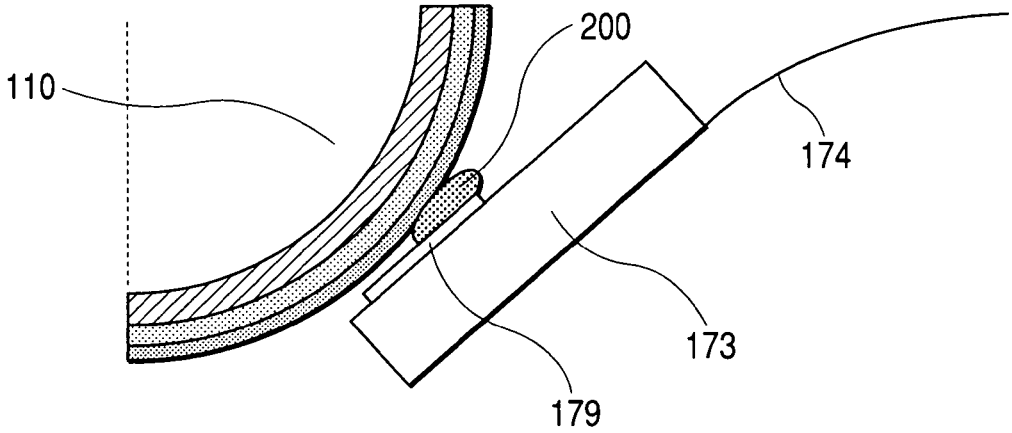
FIG. 30 is a view for explaining an example of the contact failure of the temperature sensor.
Figure 31:
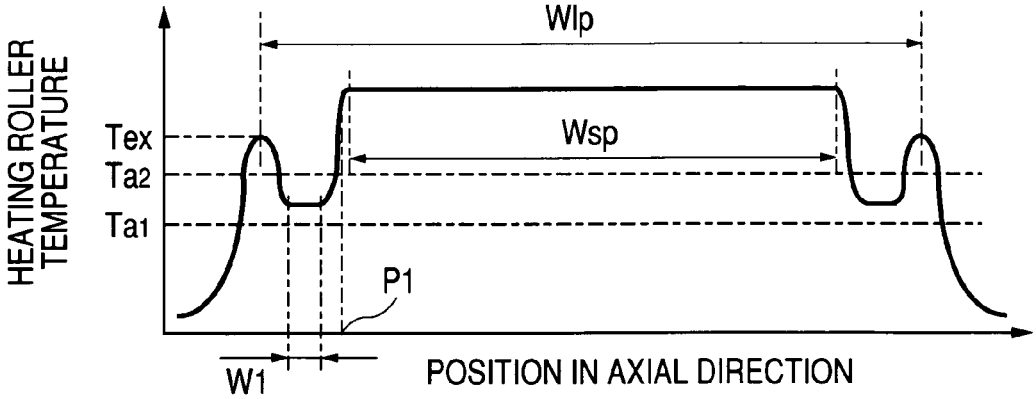
FIG. 31 is a chart showing an example of the temperature distribution of a heating roller at time of abnormal warm-up.

Next, description will be given to the position of a temperature sensor to be provided in the fixing device. FIG. 27 is a view for explaining the position of a temperature sensor, FIG. 28 is a view for explaining the position of attachment of the temperature sensor, FIG. 29 is a view showing the schematic front and section of the temperature sensor, FIG. 30 is a view for explaining an example of the contact failure of the temperature sensor, and FIG. 31 is a chart showing an example of the temperature distribution of a heating roller at time of abnormal warm-up.

In the fixing device, an end temperature sensor 171 is provided in a position in which the peak of heat distribution of the first heater is caused to overlap with the peak of heat distribution of the second heater, and a central part temperature sensor 172 is provided in a position of a central reference line in an axial direction thereof as shown in FIG. 27. The first heater is ON/OFF controlled based on the temperature detection information of the central part temperature sensor 172 provided in the central part of the heating roller, and the second heater is ON/OFF controlled based on the temperature detection information of the end temperature sensor 171.

Figure 28:
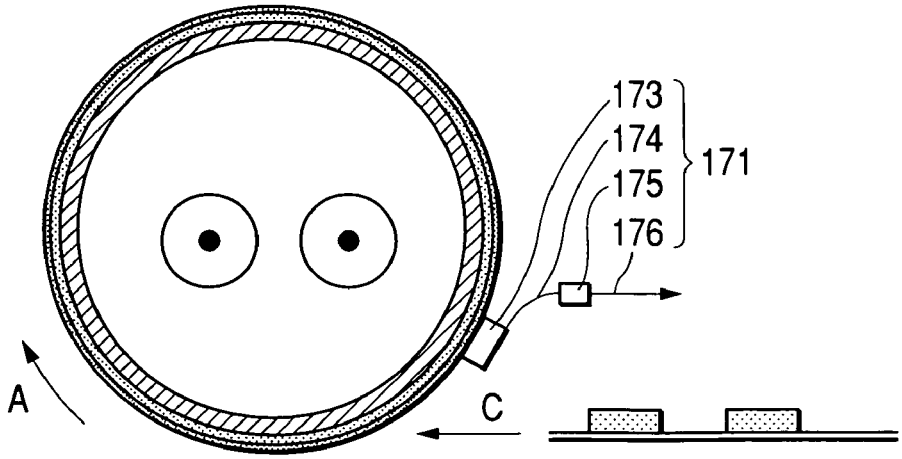
FIG. 28 is a view for explaining the position of attachment of the temperature sensor.

As shown in the sectional view of FIG. 28, the end temperature sensor 171 is constituted by a contact portion 173 for coming in contact with the heating roller, a plate spring portion 174 for elastically supporting the contact portion 173, a rigid support portion 175 for fixedly supporting the plate spring portion 174, and a signal line 176 for fetching a signal, and the contact portion 173 is supported by the rigid support portion 175 to elastically come in contact with the heating roller. Furthermore, FIG. 29 is a view showing the schematic front and section in which the temperature sensor of the contact portion 173 is enlarged.

Figure 29:
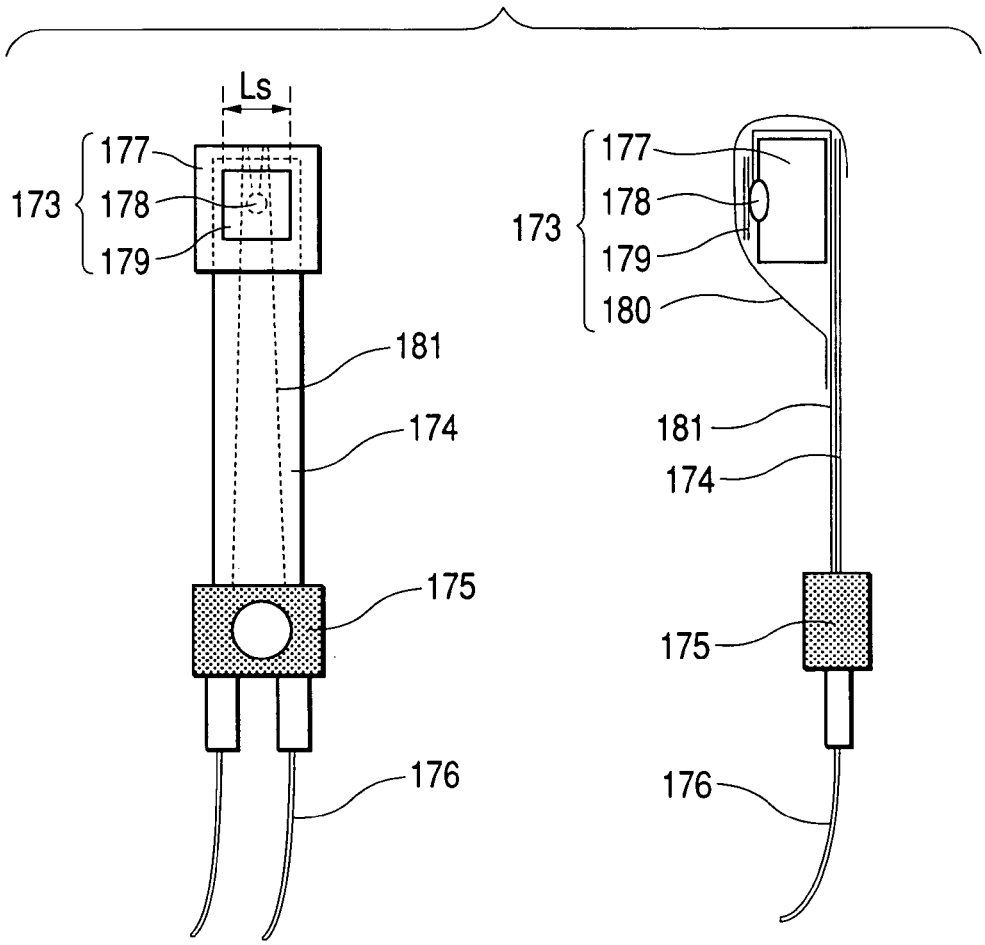
FIG. 29 is a view showing the schematic front and section of the temperature sensor.

As shown in FIG. 29, in the contact portion 173, an elastic member 177 is attached to the tip of the plate spring portion 174, a resistor 178 to be a temperature sensor is provided on a surface thereof, and furthermore, a metal plate 179 is stuck thereto, and the elastic member 177, the resistor 178 and the metal plate 179 are covered with a heat-resistant resin layer 180. The heat-resistant resin layer 180 serves to cover the contact portion 173 including at least the elastic member 177, the resistor 178 and the metal plate 179 to come in contact with the heating roller with a low friction. A lead wire 181 is extended from the resistor 178 to the rigid support portion 175 along the surface of the plate spring portion 174 and is connected to the signal line 176. A width Ls of the metal plate 179 shown in the drawing is set to be smaller than the length Lhf (shown in FIG. 27) of the holding portion filament provided on both side ends of the first heater. Consequently, a temperature peak caused by the heat distribution of the holding portion filament can be detected with high precision.

In the fixing device according to the embodiment, the central part temperature sensor 172 is apt to become dirty with paper powder or an offset toner in a very small amount due to the passage of the paper based on a center. For example, when a dirt 200 is accumulated on the contact portion 173 of the central part temperature sensor 172 as shown in FIG. 30, the contact portion 173 is separated from the surface of the heating roller 110 and the temperature of the metal plate 179 becomes lower than the actual temperature of the surface of the heating roller 110. Since the detected temperature is lower than the actual temperature, thus, the first heater is maintained to be ON for a longer period of time. In the case in which such an abnormality is generated, the first heater is maintained to be ON for a longer period of time than the second heater when warm-up is carried out. Consequently, the temperature distribution of the heating roller shown in FIG. 31 is obtained immediately after the end of the warm-up. More specifically, the influence of the heat distribution of the first heater is increased, resulting in a rise in temperatures in portions corresponding to the heat distribution peaks on both side ends in the basic image region Wsp and the maximum image region Wlp.

In FIG. 31, a target temperature range is represented as Ta1 and Ta2 and a temperature decided to be an excessive raised temperature caused by an abnormality is represented as Tex. In the embodiment, the end temperature sensor is provided in the position in which the peak of heat distribution of the first heater and that of the heat distribution of the second heater are caused to overlap with each other as described above. Therefore, the excessive raised temperature Tex can be detected precisely. More specifically, the excessive raised temperature Tex can be detected earlier in the temperature peak in the position in which the end temperature sensor is provided than that in a region W1 (a flat portion) on the outside of the basic image region Wsp and on the inside of the maximum image region Wlp as shown in FIG. 31.

Consequently, it is possible to shorten a time taken from the detection of the excessive raised temperature to the OFF operation of the power source of the first heater, and it is possible to prevent the excess temperature rising state from being continued until the first heater is disconnected. Moreover, it is possible to prolong a lifetime in the case in which the central part temperature sensor is cleaned up and repaired and the first heater is then used continuously.

In order to detect the excessive raised temperature earlier, the end temperature sensor may be provided in a portion (a dotted line P1 shown in the drawing) on the slight outside of the basic image region Wsp in which a temperature distribution is inclined as shown in FIG. 31. This portion also corresponds to a portion (a dotted line P2 shown in the drawing) on the slight outside of the basic image region Wsp in which a temperature distribution is inclined in the heat distribution of the second heater shown in FIGS. 13A and 13B, and furthermore, corresponds to the wire filament Wf between the coil filament Kf and the holding portion filament Hf. For this reason, three variations, that is, variations in the heat generation of the coil filament Kf and the holding portion filament Hf, and furthermore, a variation in the length of the wire filament Wf (an interval between the coil filament Kf and the holding portion filament Hf) overlap with each other so that a variation in manufacture of an inclining condition is increased. Accordingly, it is hard to provide the end temperature sensor in this portion to control the second heater within a proper temperature range because a control temperature is to be regulated for each apparatus. In the case in which the excessive raised temperature is to be detected in this portion, therefore, it is preferable to provide a temperature sensor to be used for the ON/OFF control of the second heater in the region W1 shown in FIG. 31 or a position corresponding to the peak of heat distribution of the second heater.

Figure 32:
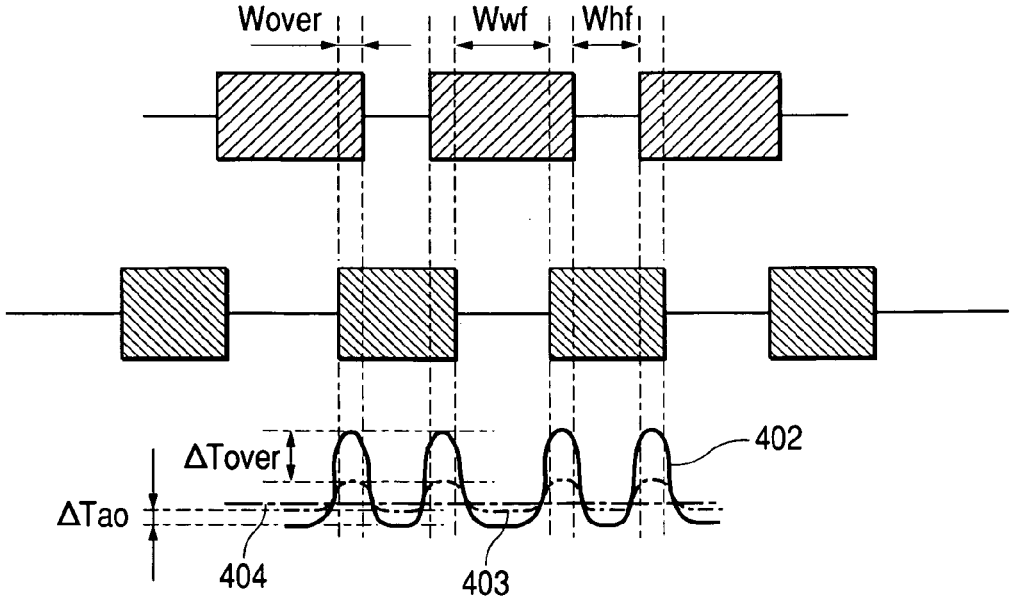
FIG. 32 is an explanatory view showing, in detail, the positional relationship between a temperature ripple and a filament.

FIG. 32 is an explanatory view showing, in detail, the positional relationship between a temperature ripple and a filament.

When the first heater is turned ON at a full capacity of 100% and the second heater is turned ON at a full capacity of 100% during warm-up and is turned ON by 30% during the passage of a thick paper having a small size as described above, the positional relationship between the temperature ripple and the filament in that case is obtained as shown in FIG. 32. More specifically, based on a temperature ripple 402 obtained immediately after the end of the warm-up and a temperature ripple 403 obtained during the continuous passage of a thick paper, a variation in a temperature of ΔTover appears above a heating roller surface temperature 404 acquired by averaging the temperature ripple in a region Wover in which the coil filament of the first heater and the holding portion filament of the second heater overlap with each other, and a variation in a temperature of ΔTao appears below the heating roller surface temperature 404 acquired by averaging the temperature ripple in regions Wwf and Whf in which the coil filament of the first heater and the wire filament of the second heater or the wire filament of the first heater and the holding portion filament of the second heater overlap with each other.

In order to reduce the influence of the second heater on the first heater in the basic image region Wsp to set the holding portion filament as an original portion in which heat generation is not carried out, the length of the coil is designed to be as small as possible. For this reason, the region Wover is designed to be shorter than the region Wwf+Whf. As a result, the heating roller surface temperature obtained by averaging the temperature ripple approximates to a temperature in the region Wwf or Whf. Accordingly, ΔTover>ΔTao is obtained.

A width Ls of the metal plate 179 shown in the drawing is set to be smaller than that of the region Wwf in which the coil filament of the first heater overlaps with the wire filament of the second heater as shown in FIG. 32. Consequently, it is possible to detect, with high precision, the surface temperature of the heating roller in the region in which the coil filament of the first heater overlaps with the wire filament of the second heater.

Figure 33:
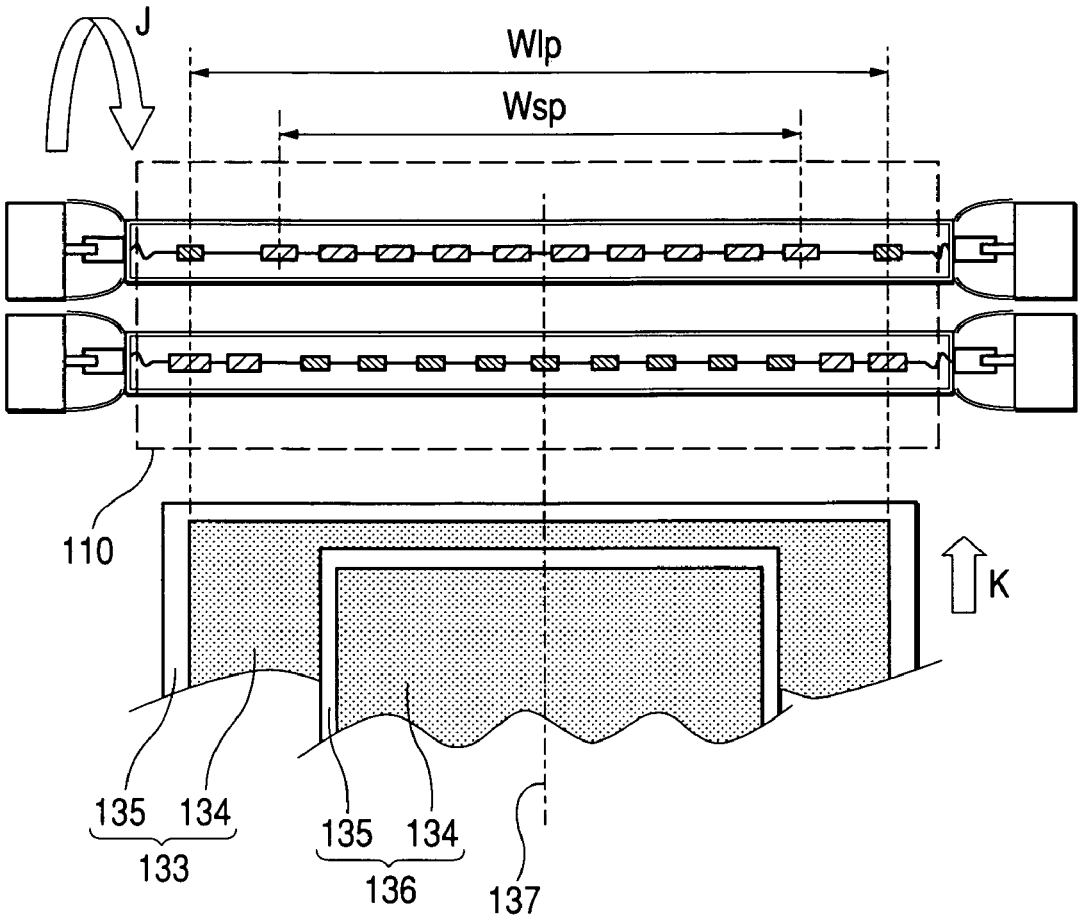
FIG. 33 is a view for explaining a paper passing state.
Figure 34:
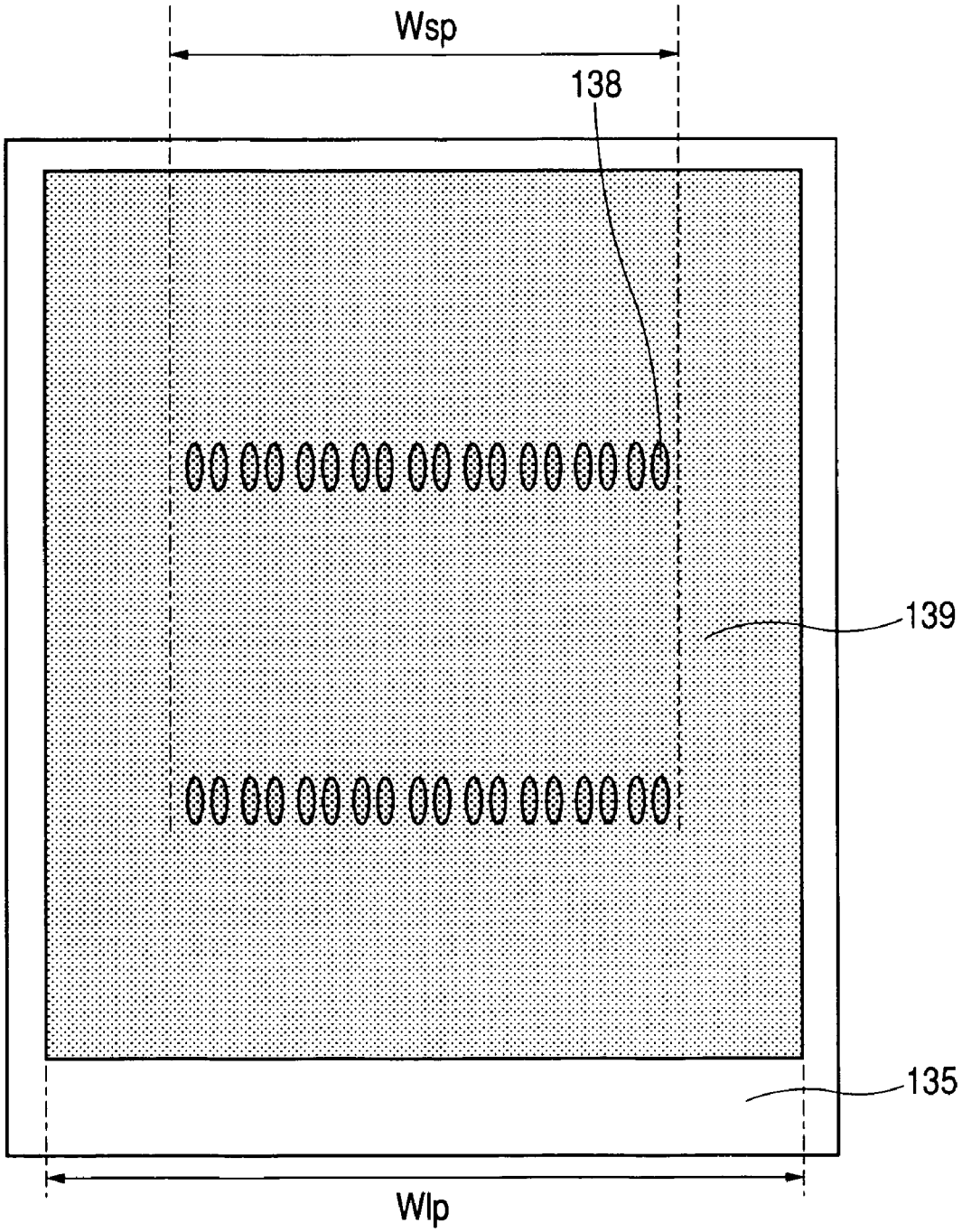
FIG. 34 is a view showing an example of an image gloss unevenness.
Figure 36:
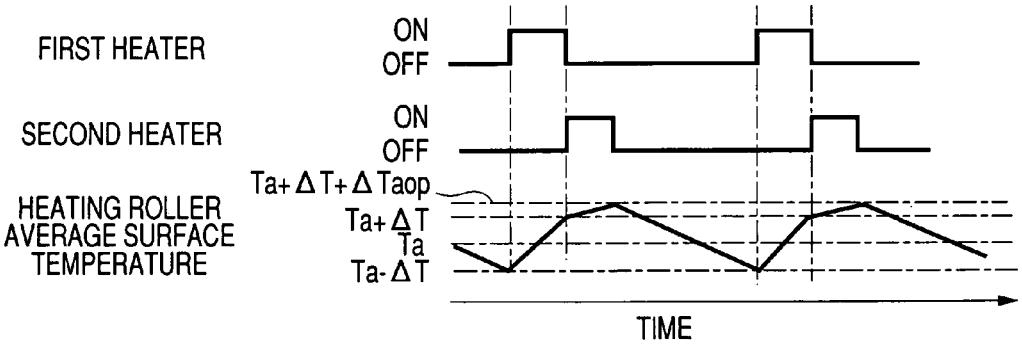
FIG. 36 is a chart showing a maximum variation in the surface temperature of the heating roller according to an example.
Figure 37:
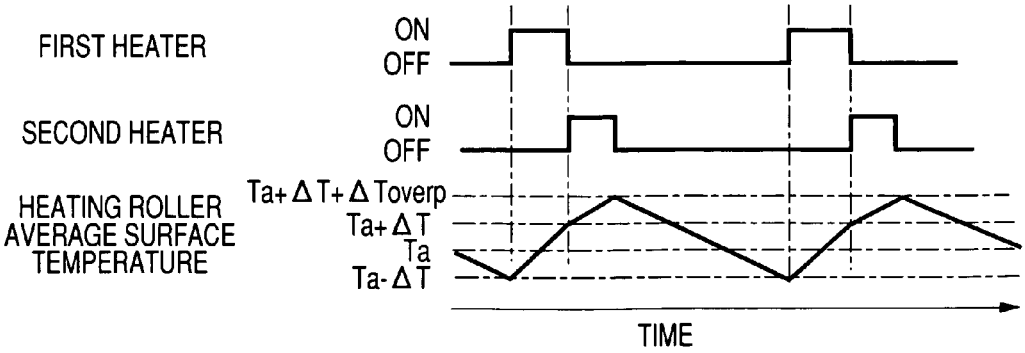
FIG. 37 is a chart showing a maximum variation in the surface temperature of the heating roller according to a comparative example.

Next, description will be given to an image gloss unevenness appearing due to the passage of a paper in an example and a comparative example of the fixing device according to the embodiment. FIG. 33 is a view for explaining a paper passing state, FIG. 34 is a view showing an example of an image gloss unevenness, FIG. 35 is a chart showing a change in the surface temperature of the heating roller in case of the control of the temperature which is to be carried out by only the first heater, FIG. 36 is a chart showing a maximum variation in the surface temperature of the heating roller according to the example, and FIG. 37 is a chart showing a maximum variation in the surface temperature of the heating roller according to the comparative example.

In the example, the metal plate 179 of the central part temperature sensor having the structure shown in FIG. 29 abuts on the region Wwf or Whf shown in FIG. 32. In the comparative example, the metal plate 179 of the central part temperature sensor abuts on the region Wover shown in FIG. 32. Description will be given to a difference in an image which is made in the case in which the halogen lamps shown in FIGS. 12A, 12B, 13A and 13B are provided in the heating roller of the fixing device shown in FIG. 1 or 2. As shown in FIG. 33, the halogen lamps shown in FIGS. 12A, 12B, 13A and 13B are provided as the first and second heaters in the heating roller of the fixing device shown in FIG. 1 or 2 (a contour shown in a thick dotted line of the drawing) respectively, and they are maintained at a high temperature and are rotated in a direction of an arrow J, and a paper 133 having a maximum size or a paper 136 having a smaller size are caused to pass in a direction of an arrow K and a whole gray and solid unfixed image formed thereon is fixed. Papers having various sizes are caused to pass through a central reference 137.

According to the example in which the metal plate 179 of the central part temperature sensor having the structure shown in FIG. 29 abuts on the region Wwf or Whf shown in FIG. 32, the heating roller is maintained at a high temperature and is rotated in the direction of the arrow J, and the paper 133 having the maximum size or the paper 136 having the smaller size is caused to pass in the direction of the arrow K and a whole gray and solid unfixed image formed thereon is fixed. Also immediately after the end of the warm-up, consequently, an excellent solid fixed image is obtained. According to the comparative example in which the metal plate 179 of the central part temperature sensor abuts on the region Wover shown in FIG. 32, however, also in the case in which the whole gray and solid unfixed image is fixed, an unevenness in a high gloss portion is generated in the basic image region Wsp as shown in FIG. 36 when the paper 133 having the maximum size including the maximum image region Wlp is caused to pass. This corresponds to the overlapping portion of the holding portion filament of the second heater and the coil filament of the first heater in the basic image region Wsp and is synchronized with the ON operation of the second heater.

Figure 35:
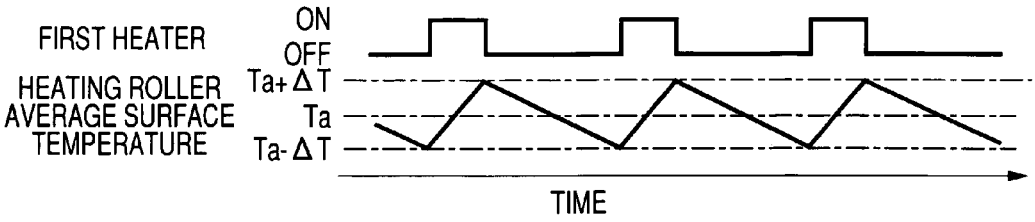
FIG. 35 is a chart showing a change in the surface temperature of the heating roller in case of the control of the temperature which is to be carried out by only the first heater.

In the heating roller, when the second heater is maintained to be OFF and only the first heater is ON/OFF controlled, a temperature is obtained by averaging a temperature ripple in the basic image region Wsp of the heating roller as shown in FIG. 35. The temperature of the first heater is controlled to be a target temperature Ta by the central part temperature sensor. The first heater is turned OFF when the temperature detected by the central part temperature sensor is indicated as Ta+ΔT, and is turned ON when the same temperature is indicated as Ta−ΔT.

In the example in which the metal plate 179 of the central part temperature sensor abuts on the region Wwf or Whf shown in FIG. 32, a temperature is acquired by averaging the temperature ripple in the basic image region Wsp of the heating roller as shown in FIG. 36. There is shown the case in which the second heater is ON/OFF controlled based on the temperature detected by the end temperature sensor independently of the first heater and the influence of the holding portion filament of the second heater is the greatest.

In FIG. 36, the first heater is turned OFF when the temperature detected by the central part temperature sensor is indicated as Ta+ΔT. In some cases, the second heater is turned ON. Therefore, the surface temperature of the heating roller is continuously raised to Ta+ΔT+ΔTaop by the holding portion filament of the second heater. In addition, ΔTaop is greater than ΔTao shown in FIG. 32. The reason is that a comparison is carried out at a duty of the second heater of 100% and 30% in FIG. 32, while the cases of ON (100% ON) and OFF (0% ON) are instantaneously compared with each other in FIG. 36. Accordingly, a variation in the temperature of the heating roller in this case ranges from a maximum Ta−ΔT to Ta+ΔT+ΔTaop.

In the comparative example in which the metal plate 179 of the central part temperature sensor abuts on the region Wover shown in FIG. 32, a temperature is acquired by averaging the temperature ripple in the basic image region Wsp of the heating roller as shown in FIG. 37. There is shown the case in which the second heater is ON/OFF controlled based on the temperature detected by the end temperature sensor independently of the first heater and the influence of the holding portion filament of the second heater is the greatest.

Also in FIG. 37, the first heater is turned OFF when the temperature detected by the central part temperature sensor is indicated as Ta+ΔT. In some cases, the second heater is turned ON. Therefore, the surface temperature of the heating roller is continuously raised to Ta+ΔT+ΔToverp by the holding portion filament of the second heater. In addition, ΔToverp is greater than ΔTover shown in FIG. 32. The reason is that a comparison is carried out at a duty of the second heater of 100% and 30% in FIG. 32, while the cases of ON (100% ON) and OFF (0% ON) are instantaneously compared with each other in FIG. 37. Accordingly, a variation in the temperature of the heating roller in this case ranges from a maximum Ta−ΔT to Ta+ΔT+ΔToverp.

In a maximum variation in the surface temperature of the heating roller according to each of the example and the comparative example, ΔTaop<ΔToverp is obtained for the same reasons as those described above with reference to FIG. 32. Therefore, it is possible to more reduce the maximum variation in the surface temperature of the heating roller in the example than that in the comparative example.

Figure 38:
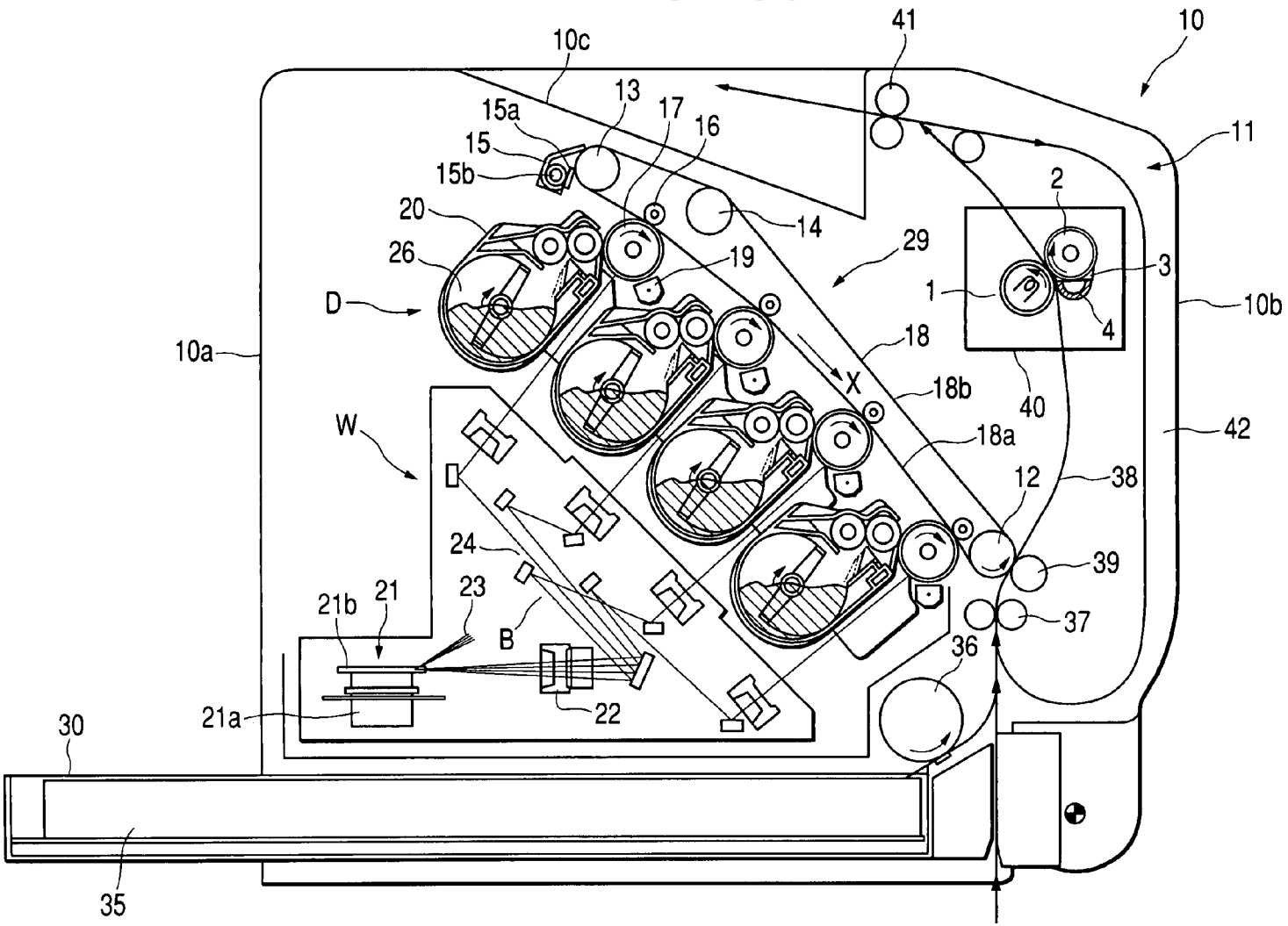
FIG. 38 is a typical sectional view showing the whole structure of an image forming apparatus according to an embodiment of the invention.

FIG. 38 is a typical sectional view showing the whole structure of an image forming apparatus according to the embodiment of the invention. In FIG. 38, 10 denotes an image forming apparatus, 10*a* denotes a housing, 10*b* denotes a door member, 11 denotes a paper delivery unit, 15 denotes cleaning unit, 17 denotes an image carrier, 18 denotes an image transfer and delivery unit, 20 denotes developing unit, 21 denotes scanner unit, 21*b* denotes a rotary polygon mirror, 29 denotes a transfer belt unit, 30 denotes a paper feed unit, 40 denotes fixing unit, W denotes an exposing unit, and D denotes an image forming unit.

In FIG. 38, the image forming apparatus 10 according to the embodiment has the housing 10*a*, a paper discharge tray 10*c* formed in the upper part of the housing 10*a*, and the door member 10*b* attached openably to the front surface of the housing 10*a*, and the exposing unit (exposing unit) W, the image forming unit D, the transfer belt unit 29 having the image transfer and delivery unit and the paper feed unit 30 are provided in the housing 10*a*, and the paper delivery unit 11 is provided in the door member 10*b*. Each unit is removably attached to a body, and can be removed integrally to be repaired or replaced at time of maintenance.

The image forming unit D includes image forming stations Y (for yellow), M (for magenta), C (for cyan) and K (for black) for forming images having a plurality of (four in the embodiment) different colors. Each of the image forming stations Y, M, C and K has the image carrier 17 formed by a photosensitive drum, charging unit 19 formed by corona charging unit which is provided around the image carrier 17, and the developing unit 20. These image forming stations Y, M, C and K are arranged in parallel in such a manner that the image carrier 17 is turned upward along an oblique arch-shaped line on the underside of the transfer belt unit 29. The order of the arrangement of the image forming stations Y, M, C and K is optional.

The transfer belt unit 29 comprises a driving roll 12 provided on the lower side of the housing 10*a* and rotated by a driving source which is not shown, a driven roll 13 provided obliquely and upward from the driving roll 12, a backup roll (a tension roll) 14, the image transfer and delivery unit 18 formed by an intermediate transfer belt which is provided between these three rolls or at least two of them and is circulated in a direction of an arrow in the drawing (a counterclockwise direction X), and the cleaning unit 15 for abutting on the surface of the image transfer and delivery unit 18. The driven roll 13, the backup roll 14 and the image transfer and delivery unit 18 are provided in a leftward inclined direction to the driving roll 12 in the drawing. Consequently, a belt surface 18*a* having the downward belt delivery direction X during the driving operation of the image transfer and delivery unit 18 is positioned in a lower part and a belt surface 18*b* having the upward belt delivery direction X is positioned in an upper part.

Accordingly, the image forming stations Y, M, C and K are also provided in the leftward inclined direction to the driving roll 12 in the drawing. The image carrier 17 comes in contact with the belt surface 18*a* in the downward delivery direction of the image transfer and delivery unit 18 along the arch-shaped line and is rotated in the delivery direction of the image transfer and delivery unit 18 as shown in an arrow of the drawing. The non-end sleeve-shaped image transfer and delivery unit 18 having a flexibility comes in contact with the image carrier 17 to be covered from above at an almost equal winding angle. Therefore, a contact pressure and a nip width between the image carrier 17 and the image transfer and delivery unit 18 can be regulated by controlling a tension to be applied to the image transfer and delivery unit 18*by* the tension roll 14, the arrangement interval of the image carrier 17, and a winding angle (a curvature of an arch).

The driving roll 12 also serves as the backup roll of a secondary transfer roll 39. A rubber layer having a thickness of approximately 3 mm and a volume resistivity of $10^5$ Ω cm or less is formed on the peripheral surface of the driving roller 12, for example, and is grounded through a metallic shaft and thus serves as a conducting path for a secondary transfer bias to be supplied through the secondary transfer roll 39. Thus, the rubber layer having a high friction and a shock absorbing property is provided on the driving roll 12. In the entrance of a recording medium into the secondary transfer portion, consequently, a shock is transmitted to the image transfer and delivery unit 18 with difficulty and a deterioration in picture quality can be prevented. By setting the diameter of the driving roll 12 to be smaller than the diameters of the driven roll 13 and the backup roll 14, moreover, the recording paper subjected to the secondary transfer can easily be separated by its own elastic force. Furthermore, the driven roll 13 is also used for the backup roll of the cleaning unit 15 which will be described below.

The image transfer and delivery unit 18 is provided in a rightward inclined direction to the driving roll 12 in the drawing. Correspondingly, the image forming stations Y, M, C and K may be provided along an oblique arch in the rightward inclined direction to the driving roll 12*in* the drawing, that is, symmetrically with respect to those in FIG. 38. While a tandem type is shown, moreover, each of the image forming stations Y, M, C and K may be of a rotary type.

A suitable material for the image transfer and delivery unit includes a PC resin, a PET resin, a polyimide resin, an urethane resin, a silicone resin, a polyether resin and a polyester resin. As a matter of course, a corresponding additive may be added in order to set a conductivity, a rigidity, a surface roughness or a coefficient of friction to be a desirable characteristic. Referring to the rigidity, moreover, a desirable rigidity can also be set by setting a thickness.

In an example, the image transfer and delivery unit was formed by the urethane resin and the polyether resin which have comparatively small rigidities and leave neither a permanent strain nor a creep, and a tension P of 40N and a winding angle α of an image carrier of 4 degrees were set by an energizing force F of the roll and a contact pressure f acting on a nip portion was set to be approximately 2.8N (=40N×sin 4 degrees). Thus, stable transfer conditions were set. In consideration of the materials, however, it was confirmed that desirable transfer conditions can be set by setting a combination of a tension P of 10N to 100N and a winding angle α of the image carrier of 0.5 to 15 degrees by the energizing force F of the roll.

While a primary transfer member 16 is provided, as transfer bias applying unit for sequentially superposing and transferring toner images to form an image, in a position placed in contact with the inside of the image transfer and delivery unit, it is not necessary to apply a pressing force for forming a transfer nip by the application of the contact pressure f. Since it is sufficient that the primary transfer member 16 simply comes in contact as an element capable of maintaining conduction to the image transfer and delivery unit, it can also be constituted by a conductive roll to be driven and rotated in contact with the image transfer and delivery unit or a rigid contact, or a conductive brush formed by a conductive elastic member such as a plate spring or a fiber group such as a resin, for example. Accordingly, a sliding resistance to the image transfer and delivery unit is small, mutual lifetimes can be prolonged, and furthermore, an inexpensive structure can be obtained.

As described above, the image forming apparatus according to the embodiment has such a structure that a plurality of image carriers 17 is arranged in parallel, the non-end sleeve-shaped image transfer and delivery unit 18 having a flexibility is provided in contact in an attitude having an almost equal winding angle for each of the image carriers 17 and is provided over at least two rolls 12 and 13 to be rotated, and a tension is applied to the image transfer and delivery unit 18 by means of either of the rolls 12 and 13 to sequentially superpose and transfer the toner image of the image carrier 17. Thus, an almost identical nip can easily be formed in the contact portion of the image carrier 17 with the image transfer and delivery unit 18 corresponding to the almost equal winding angle, and the contact pressure of the contact portion is also set to be equal.

On the other hand, in the image carrier 17 and the image transfer and delivery unit 18 to be driven in contact therewith, it is preferable that both moving circumferential speeds of the contact portions should be coincident with each other. In a mass production configuration, however, it is not realistic to set the moving circumferential speeds to be completely equal to each other due to a variation in the outside diameter or eccentricity of the image carrier 17 or the eccentricity of driving unit, or a variation in the diameter of the driving roll 12 in the image transfer and delivery unit 18 or the driving unit.

In consideration of these variations, the moving speed of the image transfer and delivery unit 18 is relatively higher or lower than that of the image carrier 17 so that a variation is made, which is not preferable in order to set various transfer conditions. It is rather preferable that the relative speed should have a relative speed difference made by a shift in either direction from the image carrier 17. If an extreme speed difference is made, however, the position of a toner image to be delivered by the image carrier 17 is shifted when it is transferred to the image transfer and delivery unit 18. Consequently, an image disorder is generated. For this reason, it is preferable to set a speed difference to be as small as possible.

In the case in which the speed difference made by the contents is set to be a relative speed difference shifted in either direction for a plurality of image carriers 17, it is preferable that the speed of the image transfer and delivery unit 18 should be set to be approximately ±(direction) 3±(variation) 2% of the moving speed of the image carrier 17 in consideration of a real ability in mass production and the limit of an image disorder.

In the case in which the moving speed of the image carrier 17 is equal to that of the image transfer and delivery unit 18, moreover, the toner image is transferred by the electrical energy action of a transfer bias. In the case in which the speed difference is made, a mechanical scraping action is also added to the electrical energy action so that a transfer efficiency can be enhanced. Consequently, it is possible to abolish or simplify the step of cleaning the transfer remaining toner of the image carrier 17.

If a relative speed difference is made between the moving speed of the image carrier 17 and that of the image transfer and delivery unit 18, furthermore, a slack is generated in the driving roll 12 of the image transfer and delivery unit 18 having a flexibility or an abutment nip on the image carrier 17, which is not preferable. In the case in which the speed of the image transfer and delivery unit 18 is changed in an increasing direction with respect to the image carrier 17, therefore, the driving roll 12 of the image transfer and delivery unit 18 is provided on a downstream side. In the case in which the speed of the image transfer and delivery unit 18 is changed in a reducing direction with respect to the image carrier 17, the driving roll 12 of the image transfer and delivery unit 18 is provided on an upstream side so that the slack can be prevented from being generated. Thus, preferable transfer conditions can be set.

The cleaning unit 15 is provided on the belt surface 18*a* side in a downward delivery direction and includes a cleaning blade 15*a* for removing a toner remaining on the surface of the image transfer and delivery unit 18 after a secondary transfer and a toner delivery member 15*b* for delivering the collected toner. The cleaning blade 15*a* abuts on the image transfer and delivery unit 18 in the winding portion of the image transfer and delivery unit 18 upon the driven roller 13. Moreover, the primary transfer member 16 abuts on the back face of the image transfer and delivery unit 18 opposite to the image carrier 17 of each of the image forming stations Y, M, C and K which will be described below, and a transfer bias is applied to the primary transfer member 16.

The exposing unit W is provided in a space formed obliquely below the image forming unit D provided in an oblique direction. Moreover, the paper feed unit 30 is provided in the bottom portion of the housing 10*a* under the exposing unit W. The whole exposing unit W is accommodated in a case, and the case is provided in a space formed obliquely below the belt surface in the downward delivery direction. The single scanner unit 21 including a polygon mirror motor 21*a* and the polygon mirror (rotary polygon mirror) 21*b* is provided horizontally in the bottom portion of the case, and furthermore, a single f-θ lens 22 and a plurality of reflecting mirrors 24 to turn back scanning optical paths for respective colors in non-parallel with the image carrier 17 are provided in an optical system B for reflecting, by means of the polygon mirror 21*b*, a laser beam emitted from a plurality of laser beam sources 23 to be modulated by image signals for the colors and carrying out deflection and scan over each image carrier 17.

In the exposing unit W having the structure described above, the image signal corresponding to each color is sent from the polygon mirror 21*b* as the laser beam modulated and formed based on a common data clock frequency, and is irradiated on the image carrier 17 of each of the image forming stations Y, M, C and K through the f-θ lens 22 and the reflecting mirror 24 so that a latent image is formed. By providing the reflecting mirror 24, the scanning optical path is bent so that the height of the case can be decreased and the size of the optical system B can be reduced. In addition, the reflecting mirror 24 is provided in such a manner that the scanning optical path lengths to the image carriers 17 of the image forming stations Y, M, C and K are equal to each other. Thus, the length of the optical path (the optical path length) from the polygon mirror 21*b* in the exposing unit W to the image carrier 17 with respect to each image forming unit D is set to be almost equal. Consequently, the scanning widths of the light beams scanned in the optical paths are almost equal to each other so that a special structure is not required for forming the image signal. Although the laser beam source 23 is modulated corresponding to images having different colors from each other in response to different image signals from each other, accordingly, the modulation and formation can be carried out based on a common data clock frequency. Since a common reflecting surface is used, it is possible to prevent a color difference from being made by a relative difference in a subscanning direction. Thus, it is possible to constitute an inexpensive color image forming apparatus having a simple structure.

In the embodiment, moreover, the scanning optical system B is provided in the lower part of the apparatus. Consequently, it is possible to minimize the vibration of the scanning optical system B caused by a vibration to be applied to a frame supporting the apparatus by means of the driving system of the image forming unit. Consequently, a deterioration in picture quality can be prevented. By providing the scanner unit 21 in the bottom portion of the case, particularly, it is possible to minimize a vibration to be applied to the whole case by the polygon motor 21*a* itself, thereby preventing a deterioration in picture quality. By setting the number of the polygon motors 21*a* to be vibrating sources to be one, moreover, it is possible to minimize the vibration to be applied to the whole case.

In the embodiment, each of the image stations Y, M, C and K is provided in an oblique direction and the image carrier 17 is arranged in parallel in an upward direction along the oblique arch-shaped line, and a toner storage container 26 is provided with an oblique and downward inclination in order to come in contact with the belt surface 18*a* of the image transfer and delivery unit 18 in the downward delivery direction.

The paper feed unit 30 includes a paper feed cassette 35 for laminating and holding recording media and a pick-up roll 36 for feeding the recording media from the paper feed cassette 35 one by one. The paper delivery unit 11 includes a gate roll pair 37 for defining the paper feed timing of the recording medium to the secondary transfer portion (one of the rolls is provided on the housing 10*a* side), the secondary transfer roll 39 to be secondary transfer unit for coming in pressure contact with the driving roll 12 and the image transfer and delivery unit 18, a main recording medium delivery path 38, the fixing unit 40, a paper discharge roll pair 41, and a delivery path 42 for perfecting printing.

A secondary image (an unfixed toner image) transferred secondarily to a sheet material is fixed at a predetermined temperature in the nip portion formed by the fixing unit 40. In the embodiment, the fixing unit 40 can be provided in the space formed obliquely and upward from the belt surface 18*b* in the upward delivery direction of the transfer belt, that is, the space on the opposite side of the image forming station with respect to the transfer belt, a heat transfer to the exposing unit W, the image transfer and delivery unit 18 and the image forming unit can be reduced, and a frequency of the execution of a color difference correcting operation for each color can be decreased. In particular, the exposing unit W is placed in the most distant place from the fixing unit 40 and a displacement of scanning optical system components by heat can be minimized so that a color difference can be prevented from being made.

In the embodiment, the image transfer and delivery unit 18 is provided in an inclined direction to the driving roll 12. Therefore, a large space is generated in a right space in the drawing so that the fixing unit 40 can be provided in the space and the size can be reduced, and furthermore, the heat generated from the fixing unit 40 can be prevented from being transmitted to the exposing unit W, the image transfer and delivery unit 18 and the image forming stations Y, M, C and K which are positioned on the left side. Moreover, the exposing unit W can be provided in the left and lower space of the image forming unit D. Therefore, it is possible to minimize the vibration of the scanning optical system B of the exposing unit W which is caused by the vibration to be applied to the housing 10*a* by the driving system of the image forming unit. Thus, a deterioration in picture quality can be prevented.

In the embodiment, furthermore, a spherical toner is used. Therefore, a primary transfer efficiency can be enhanced (approximately 100%) and each image carrier 17 is not provided with the cleaning unit for collecting the primary transfer remaining toner. Consequently, the image carriers 17 formed by a photosensitive drum having a diameter of 30 mm or less can be provided close to each other so that the size of the apparatus can be reduced.

The cleaning unit is not provided, and furthermore, the corona charging unit 19 is employed as the charging unit. In the case in which the charging unit is a roll, the primary transfer remaining toner present in a very small amount on the image carrier 17 is accumulated on the roll so that a charging failure is caused. However, the toner is stuck to the corona charging unit 19 to be non-contact charging unit with difficulty so that the generation of the charging failure can be prevented.

While the intermediate transfer belt serves as the image transfer and delivery unit 18 to come in contact with the image carrier 17 in the embodiment, moreover, a sheet material delivery belt for adsorbing a sheet material onto a surface to carry out delivery and movement and for sequentially superposing and transferring toner images on the surface of the sheet material to form and deliver an image may be used for the image transfer and delivery unit 18 to come in contact with the image carrier 17. In this case, the belt delivery direction of the sheet material delivery belt to be the image transfer and delivery unit 18 is turned upward to be a reverse direction on a lower surface to come in contact with the image carrier 17 differently from each of the embodiments.

The summary of the operation of the whole image forming apparatus described above is as follows.

(1) When a printing command signal (an image forming signal) is input from a host computer (a personal computer) which is not shown to the control unit of the image forming apparatus 10, the image carriers 17 of the image forming stations Y, M, C and K, each roll of the developing unit 20 and the image transfer and delivery unit 18 are rotated.

(2) The outer peripheral surface of the image carrier 17 is charged uniformly by the charging unit 19.

(3) Selective exposure corresponding to image information about each color is carried out, by the exposing unit, on the outer peripheral surface of the image carrier 17 charged uniformly in each of the image forming stations Y, M, C and K so that an electrostatic latent image for each color is formed.

(4) The electrostatic latent image formed on each of the image carriers 17 is developed by the developing unit 20 so that a toner image is formed.

(5) A primary transfer voltage having a reverse polarity to the charging polarity of the toner is applied to the primary transfer member 16 of the image transfer and delivery unit 18, and the toner image formed on the image carrier 17 is sequentially superposed and transferred onto the image transfer and delivery unit 18 with the movement of the image transfer and delivery unit 18 in the primary transfer portion.

(6) The recording medium accommodated in the paper feed cassette 35 is fed to the secondary transfer roll 39 through the resist roll pair 37 synchronously with the movement of the image transfer and delivery unit 18 which primarily transfers the primary image.

(7) The primary transfer image synchronously meets the recording medium in the secondary transfer portion and a bias having a reverse polarity to the polarity of the primary transfer image is applied by the secondary transfer roll 39 pressed toward the driving roll 12 of the image transfer and delivery unit 18 by a pressing mechanism which is not shown, and the primary transfer image formed on the image transfer and delivery unit 18 is secondarily transferred on to the recording medium which is fed synchronously.

(8) The transfer remaining toner in the secondary transfer is delivered in the direction of the driven roll 13 and is scraped off by the cleaning unit 15 provided opposite to the roll 13. Then, the image transfer and delivery unit 18 is refreshed so that the cycle can be repeated again.

(9) The recording medium passes through the fixing unit 40 so that the toner image on the recording medium is fixed. Thereafter, the recording medium is delivered toward a predetermined position (toward the paper discharge tray 10*c* in case of non-perfecting printing and toward the delivery path 42 for perfecting printing in case of perfecting printing).

A material having a strength, for example, carbon steel or stainless is suitable for the core constituting the heating roller. A material having a heat resistance which is resistant to fixing heat and has a proper elasticity to form a nip between the heating roller and the pressurizing roller, for example, a silicone rubber, a foamed silicone rubber, a fluorine rubber or a foamed fluorine rubber is suitable for the elastic layer. The parting layer is provided on the outermost periphery in order to easily separate a molten toner from the heating roller and has an object to prevent an offset. A material having a small surface energy, a flexibility and a heat resistance, for example, fluororesin (PFA, PTFE, PEP), a silicone resin, a fluorine rubber or a silicone rubber is preferable for the parting layer, and a thickness thereof is preferably 5 to 100 μm. For example, if the thickness is smaller than 5 μm, the parting layer is broken due to abrasion with a recording paper. To the contrary, if the thickness is greater than 100 μm, heat cannot be efficiently transferred from the heating layer because the suitable material for the parting layer has a small thermal conductivity. In other words, it takes a time to transfer the heat from the heating layer.

The core constituting the pressurizing roller mainly serves as the shaft of the pressurizing roller by an iron type material and rotatably carries out a support. The elastic layer has a heat resistance to a fixing temperature and is to have a proper elasticity for forming the heating roller and the nip, and a silicone rubber or a fluorine rubber may be used. In order to reduce the heat capacity of the pressurizing roller, it is preferable to foam these rubbers to have an adiabatic property. Consequently, it is possible to further produce advantages. The parting layer is the same as that of the heating roller.

The invention is not restricted to the embodiment but various modifications can be made. For example, while the description has been given to the fixing device including the two heaters in the image region in which the basic image region Wsp and the maximum image region Wlp are caused to correspond to A5 in a transverse direction and A3 in a vertical direction respectively in the embodiment, it is apparent that they are properly selected depending on the sizes of the image forming apparatus and the fixing device.

While the holding portion filament and the wire filament in the second heater are provided alternately with the phases alternated with those of the alternately arranged coil filament and wire filament of the first heater in the basic image region Wsp of the central region in the embodiment, it is apparent that the holding portion filament of the second heater does not need to be provided corresponding to the position of each wire filament of the first heater but may be provided corresponding to the position of the wire filament of the first heater at a proper interval. While both side ends of the maximum image region Wlp are caused to have the peak of heat distribution of the first heater and that of the heat distribution of the second heater in an overlap, moreover, the outside parts of both side ends in the maximum image region Wlp may be caused to have the peak of heat distribution of the first heater.

As is apparent from the description, the invention provides a fixing device for causing a pressurizing roller to come in pressure contact with a heating roller including a central region heating heater for heating a central region and a side end region heating heater for heating a side end region on an outside of the central region, thereby fixing an unfixed developer, or an image forming apparatus comprising the fixing device, wherein an outside of an image region of the heating roller is caused to have a peak of heat distribution of the central region heating heater, and the central region heating heater has a coil filament and a wire filament provided alternately in the central region and has a holding portion filament provided on the outside of the image region, and is caused to have the peak of heat distribution by the holding portion filament. Consequently, it is possible to compensate the heat radiated from both side ends of the heating roller, thereby flattening the temperature distribution of the image region. Thus, a deterioration in an image can be prevented. Furthermore, the heat radiation from both side ends of the heating roller can be compensated by the holding portion filament provided on both side ends of the central region heating heater. Thus, labor-saving can be achieved.

The invention provides a fixing device for causing a pressurizing roller to come in pressure contact with a heating roller including a central region heating heater for heating a central region and a side end region heating heater for heating a side end region on an outside of the central region, thereby fixing an unfixed developer, wherein both side ends of the heating roller are caused to have a peak of heat distribution of the central region heating heater and a peak of heat distribution of the side end region heating heater in an overlap. Therefore, it is possible to compensate the heat radiated from both side ends of the heating roller, thereby flattening the temperature distribution properly. Thus, a deterioration in an image can be prevented. Furthermore, the heat radiation from both side ends of the heating roller can be compensated by the holding portion filament provided on both side ends of the central region heating heater. Thus, labor-saving can be achieved.

The invention provides a fixing device for causing a pressurizing roller to come in pressure contact with a heating roller including a central region heating heater for heating a central region and a side end region heating heater for heating a side end region on an outside of the central region, thereby fixing an unfixed developer, wherein a temperature sensor for detecting a temperature of the heating roller is provided in a non-overlapping portion of a heating portion and a holding portion in the central region heating heater and the side end region heating heater. Consequently, a maximum variation in the surface temperature of the heating roller can be reduced in the central part and a variation in the control of a fixing temperature can be prevented from being increased due to the ON/OFF operation of the side end region heating heater, and a gloss unevenness can be prevented from being generated.

Moreover, the temperature sensor for detecting the temperature of the heating roller is provided in an overlapping portion of the heating portion and the holding portion in the central region heating heater and the side end region heating heater. Consequently, the excessive raised temperature of the surface of the heating roller can be properly detected on both side ends and a gloss unevenness can be prevented from being generated by the excessive raised temperature so that a deterioration in an image can be prevented.

The invention provides a fixing device for causing a pressurizing roller to come in pressure contact with a heating roller including a central region heating heater for heating a central region and a side end region heating heater for heating a side end region on an outside of the central region, thereby fixing an unfixed developer, wherein both side ends of the heating roller are caused to have a peak of heat distribution of the central region heating heater and a peak of heat distribution of the side end region heating heater. Therefore, it is possible to compensate the heat radiated from both side ends of the heating roller, thereby flattening the temperature distribution properly. Thus, a deterioration in an image can be prevented. Furthermore, the heat radiation from both side ends of the heating roller can be compensated by the holding portion filament provided on both side ends of the central region heating heater. Thus, labor-saving can be achieved.

What is claimed is:

1. A fixing device comprising:

a heating roller brought into pressure contact with a pressurizing roller, the heating roller comprising:

a first heater for heating a central region of the heating roller; and a second heater for heating side end regions of the heating roller on both sides of the central region, wherein a peak of heat distribution of the first heater is located at or near a side end of an image region; and wherein the first heater comprises coil filaments operable to emit light of a first amount and wire filaments which are provided alternately in the central region and further comprises holding portion filaments which are coil filaments operable to emit light of a second amount less than a first amount and which are provided on the outside of the image region.

2. The fixing device according to claim 1, wherein the peak of heat distribution of the first heater is located on an outside of the side end of the image region.

3. An image forming apparatus comprising the fixing device according to claim 1.

4. A fixing device comprising:

a heating roller brought into pressure contact with a pressurizing roller, the heating roller comprising:

a first heater for heating a central region of the heating roller; and a second heater for heating side regions of the heating roller on both sides of the central region, wherein a peak of heat distribution of the first heater and a peak of heat distribution of the second heater are overlapped; and wherein the second heater comprises coil filaments operable to emit light of a first amount and wire filaments which are provided alternately in the side end regions, and further comprises holding portion filaments which are coil filaments operable to emit light of a second amount less than the first amount and which are provided in the central region; and wherein the peak of heat distribution of the second heater is generated by the coil filaments.

5. The fixing device according to claim 4, wherein a plurality of the coil filaments are provided on the second heater in each of the side end regions, and a length of one of the coil filaments located on an outer side is greater than a length of another one of the coil filaments located on an inner side.

6. The fixing device according to claim 4, wherein a temperature sensor is provided near at least one end of the heating roller where the peak of heat distribution of the first heater is located.

7. The fixing device according to claim 4, wherein a temperature sensor is provided in a central part of the heating roller.

8. An image forming apparatus comprising the fixing device according to claim 4.

9. A fixing device comprising:

a heating roller brought into pressure contact with a pressurizing roller, the heating roller comprising:

a first heater having first coil filaments and first wire filaments which are arranged in a first region, and first holding portion filaments arranged in a second regions which are located in both sides of the first region;

a second heater having second coil filaments and second wire filaments which are alternately arranged in third regions, and second holding portion filaments arranged in a fourth region which is located between the third regions; and a temperature sensor operable to detect a temperature of the heating roller and opposing a non-overlapping portion in which the first coil filament and the second holding portion filament are not overlapped, wherein:

the first holding portion filaments are coil-shaped for eliminating slack of the first wire filaments;

the second holding portion filaments are coil-shaped for eliminating slack of the second wire filaments;

the first region and the fourth region are provided in a central region in an axial direction of the heating roller; and the second regions and the third regions are provided in both side regions in the axial direction of the heating roller.

10. The fixing device according to claim 9, wherein the temperature sensor is provided in the central region of the heating roller.

11. The fixing device according to claim 9, wherein a length of one of the second holding portion filaments located on an outer side in the axial direction is greater than a length of another one of the second holding portion filaments located on an inner side in the axial direction.

12. The fixing device according to claim 9, wherein a peak of heat distribution of the first heater and a peak of heat distribution of the second heater are overlapped in the side end regions.

13. An image forming apparatus comprising the fixing device according to claim 9.

14. A fixing device comprising:

a heating roller brought into pressure contact with a pressurizing roller, the heating roller comprising:

a first heater having first coil filaments and first wire filaments which are alternately arranged in a first region, and first holding portion filaments arranged in second regions which are located in both sides of the first region;

a second heater having second coil filaments and second wire filaments which are alternately arranged in third regions, and second holding portion filaments arranged in a fourth region which is located between the third regions; and a temperature sensor operable to detect a temperature of the heating roller and opposing an overlapping portion in which one of the first holding portion filaments and one of the second coil filaments are overlapped, wherein:

the first holding portion filaments are coil-shaped for eliminating slack of the first wire filaments;

the second holding portion filaments are coil-shaped for eliminating slack of the second wire filaments;

the first region and the fourth region are provided in a central region in an axial direction of the heating roller; and the second regions and the third regions are provided in both side regions in the axial direction of the heating roller.

15. The fixing device according to claim 14, wherein the temperature sensor is provided on an end of the heating roller.

16. An image forming apparatus comprising the fixing device according to claim 14.

17. The fixing device according to claim 14, wherein a length of one of the second holding portion filaments located on an outer side in the axial direction is greater than a length of another one of the second holding portion filaments located on an inner side in the axial direction.

18. A fixing device comprising:

a heating roller brought into pressure contact with a pressurizing roller, the heating roller comprising:

a first heater for heating a central region of the heating roller; and a second heater for heating side end regions of the heating roller on both sides of the central region, wherein first coil filaments operable to emit light of a first amount and first wire filaments are alternately provided in the first heater at the central region with phases alternated with phases of second wire filaments and first holding portion filaments which are provided in the second heater alternately at the central region; and wherein the first holding portion filaments are coil filaments operable to emit light of a second amount less than the first amount.

19. The fixing device according to claim 18, wherein a peak of heat distribution of the first heater and a peak of heat distribution of the second heater are overlapped in the side end region.

20. The fixing device according to claim 19, wherein the first heater has second holding portion filaments, which are coil filaments operable to emit light of an amount less than the first amount and which oppose the side end regions.

21. The fixing device according to claim 19, wherein the second heater has second coil filaments operable to emit light of an amount greater than the second amount and which oppose the side end regions.

22. The fixing device according to claim 21, wherein a plurality of the second coil filaments are provided in each of the side end regions, and a length of one of the second coil filaments located on an outer side is greater than a length of another one of the second coil filaments located on an inner side.

23. An image forming apparatus comprising the fixing device according to claim 18.

24. A fixing device comprising:

a heating roller brought into pressure contact with a pressurizing roller, the heating roller comprising:

a first heater for heating a central region of the heating roller; and a second heater for heating side end regions of the heating roller on both sides of the central region, wherein the first heater has first coil elements operable to emit light of a first amount and wire filaments which are alternately arranged so as to oppose the central region;

wherein the second heater comprises first holding portion filaments which are coil filaments operable to emit light of a second amount less than the first amount provided so as to oppose the wire filaments of the first heater.

25. An image forming apparatus comprising the fixing device according to claim 24.

* * * * *